US007207297B2

(12) United States Patent
Hayami

(10) Patent No.: US 7,207,297 B2
(45) Date of Patent: Apr. 24, 2007

(54) INTERNAL COMBUSTION ENGINE COOLING SYSTEM

(75) Inventor: Toshifumi Hayami, Kariya (JP)

(73) Assignee: DENSO Corporation (JP)

( * ) Notice: Subject to any disclaimer, the term of this patent is extended or adjusted under 35 U.S.C. 154(b) by 0 days.

(21) Appl. No.: 11/416,242

(22) Filed: May 3, 2006

(65) Prior Publication Data

US 2006/0213461 A1 Sep. 28, 2006

Related U.S. Application Data

(62) Division of application No. 10/669,605, filed on Sep. 25, 2003.

(30) Foreign Application Priority Data

Oct. 2, 2002 (JP) ..... 2002-289435
Nov. 5, 2002 (JP) ..... 2002-321514

(51) Int. Cl.
*F01P 5/14* (2006.01)
*F01P 7/14* (2006.01)

(52) U.S. Cl. ..... 123/41.15; 123/41.1; 73/117.3

(58) Field of Classification Search ..... 123/41.05, 123/41.1, 198 D, 41.15; 73/116.1, 117.2, 73/117.3, 118.1, 119 R
See application file for complete search history.

(56) References Cited

U.S. PATENT DOCUMENTS 4,567,858 A 2/1986 Hayashi
5,390,632 A 2/1995 Ikebe et al.
6,279,390 B1 * 8/2001 Oka et al. ..... 73/118.1
6,390,031 B1 5/2002 Suzuki et al.
6,520,125 B2 2/2003 Suzuki et al.
6,679,202 B2 * 1/2004 Nakano ..... 123/41.1
6,857,398 B2 2/2005 Takagi et al.
2004/0065275 A1 4/2004 Hayami et al.

FOREIGN PATENT DOCUMENTS

JP 5-288054 11/1993

* cited by examiner

*Primary Examiner*—Stephen K. Cronin
*Assistant Examiner*—Arnold Castro
(74) *Attorney, Agent, or Firm*—Nixon & Vanderhye PC

(57) ABSTRACT

In a cooling system of an internal combustion engine, coolant flowing through a radiator and bypassing the radiator are mixed in a flow control valve controlled by ECU on the basis of signals provided by sensors such as a coolant temperature sensor, so that the coolant is circulated by an electric pump to control the coolant temperature for the internal combustion engine. A desired coolant temperature is changed according to the operating condition of the internal combustion engine, the traveling condition of a vehicle and the ambient condition. A fluid control valve controls the flow rate of cooling water through the bypass passage. The flow control valve is diagnosed for abnormalities. If it is determined that the flow control valve is in an abnormal condition, a heat generation rate reducing control operation is executed to reduce the heat generation rate of the internal combustion engine.

12 Claims, 16 Drawing Sheets

INTERNAL COMBUSTION ENGINE COOLING SYSTEM

CROSS REFERENCE TO RELATED APPLICATIONS

This application is a division of application Ser. No. 10/669,605, filed Sep. 25, 2003, the entire contents of which is hereby incorporated by reference in this application.

This application is also related to and incorporates herein by reference Japanese Patent Applications No. 2002-289435 filed on Oct. 2, 2002 and No. 2002-321514 filed on Nov. 5, 2002.

FIELD OF THE INVENTION

The present invention relates to an internal combustion engine cooling system for properly controlling the temperature of cooling water (coolant) for cooling an internal combustion engine so that the internal combustion engine is kept at its most efficient temperature.

BACKGROUND OF THE INVENTION

Internal combustion engine cooling systems are disclosed in U.S. Pat. No. 6,390,031 B1 (JP-A-2000-45773) and Japanese Laid-open Publication No. 5-288054.

The internal combustion engine cooling system disclosed in the U.S. patent has a bypass passage bypassing a radiator and provided with a flow control valve, and keeps the coolant for cooling an internal combustion engine at an elevated temperature to reduce frictional resistance and fuel consumption. This internal combustion engine cooling system is able to reduce frictional resistance and fuel consumption by keeping the coolant at an elevated temperature. However, the coolant of an elevated temperature tends to cause detonation. If the flow control valve fails to operate normally due to obstruction by foreign matters stuck in the flow control valve or the malfunction of a drive circuit, it is possible that the flow of the coolant through the radiator decreases abnormally, the dissipation of the heat of the coolant by the radiator decreases, the temperature of the coolant flowing into the internal combustion engine increases abnormally, the cooling capacity of the coolant decreases and the internal combustion engine overheats.

The internal combustion engine cooling system disclosed in the Japanese laid-open publication prevents detonation by decreasing the desired inlet temperature, i.e., the desired temperature at the inlet of a coolant circulating circuit, of the coolant when detonation begins in the internal combustion engine. This internal combustion engine cooling system decreases the desired coolant temperature by a predetermined fixed temperature upon the detection of detonation while the internal combustion engine is in a heavy load operation and the coolant temperature is in a middle temperature region. However, since the coolant temperature is decreased by the fixed temperature, the coolant cannot be adjusted to an optimum temperature, and the fixed temperature can be insufficient or excessive depending on the variation of parameters such as those indicating the operating condition of the internal combustion engine and the quality of the fuel. Since this coolant temperature control increases or decreases the coolant temperature gradually, the coolant temperature control is not necessarily able to deal properly with operating conditions, traveling modes or environmental conditions, and causes detonation in a coolant temperature range near a detonation limit temperature above which detonation occurs.

SUMMARY OF THE INVENTION

Accordingly, it is a first object of the present invention to provide an internal combustion engine cooling system capable of keeping an internal combustion engine at its most efficient temperature by properly regulating the temperature of the cooling water for cooling the internal combustion engine according to various conditions, and of reducing fuel consumption.

It is a second object of the present invention to provide an internal combustion engine cooling system capable of preventing an internal combustion engine from overheating due to the malfunction of a flow control valve placed in a coolant bypass passage.

An internal combustion engine cooling system according to the first aspect of the present invention mixes the coolant flowing from an internal combustion engine and cooled while flowing through a radiator, and the coolant from a bypass passage bypassing the radiator in a flow control valve, circulates the coolant by a water pump placed in an inlet or an outlet passage, and controls the temperature of the coolant flowing through the outlet passage on the basis of a desired coolant temperature set for the coolant flowing through the outlet passage. The desired coolant temperature is adjusted according to the operating condition of the internal combustion engine, the traveling mode of the vehicle with the internal combustion engine and environmental conditions. Thus, the desired coolant temperature can properly be adjusted in a narrow temperature range near a detonation limit temperature, detonation can be prevented with a sufficient allowance, the internal combustion engine is kept at its most efficient temperature and fuel consumption can be reduced.

An internal combustion engine cooling system according to the second aspect of the present invention monitors a flow control valve, and performs a heat generation rate reducing control operation for reducing the heat generation of an internal combustion engine when the flow control valve malfunctions. Thus, even if the coolant of an excessively high temperature should be supplied to the internal combustion engine and the cooling capacity of the coolant should be reduced due to malfunction of the flow control valve, the increase of the temperature of the internal combustion engine can be suppressed and the internal combustion engine can be prevented from overheating.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS (First Embodiment)

Figure 1:
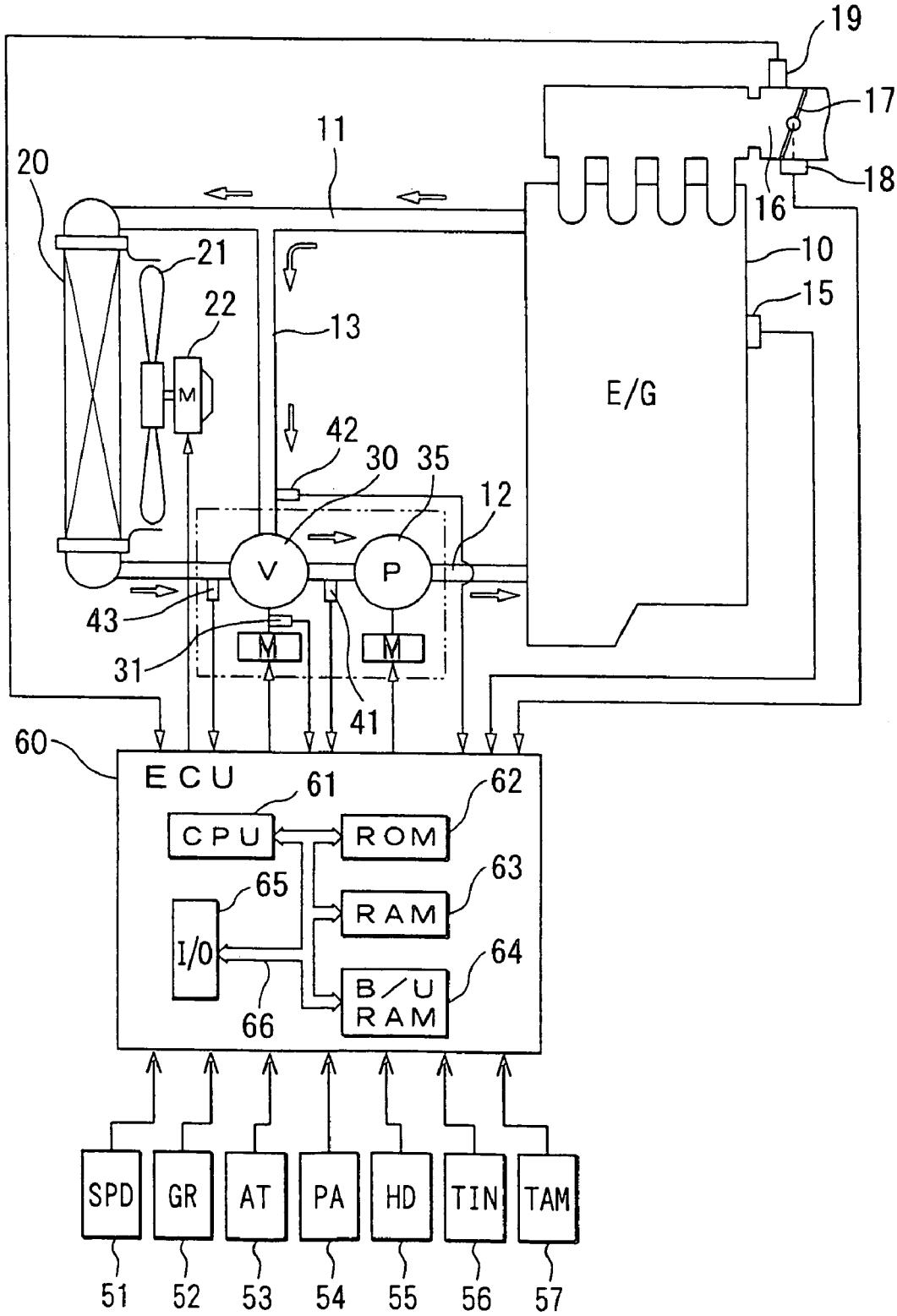
FIG. 1 is diagrammatic view of an internal combustion engine and peripheral devices to which internal combustion engine cooling systems according to the first to eleventh embodiments of the present invention are applied.

Referring to FIG. 1, an internal combustion engine 10 is connected to a radiator 20 for cooling engine cooling water (coolant) following through an inlet passage 11 and an outlet passage 12. The inlet passage 11 and the outlet passage 12 are connected by a bypass passage 13. A rotary flow control valve 30 is placed at the junction of the outlet passage 12 and the bypass passage 13. An electric water pump 35 is placed between the flow control valve 30 and the engine 10 in the outlet passage 12. A radiator fan 21 is disposed behind the radiator 20. A fan motor 22 drives the radiator fan 21 when necessary.

A potentiometer 31 is combined with the valve shaft, not shown, of the flow control valve 30 to measure the valve opening of the flow control valve 30. A first coolant temperature sensor 41 for measuring the temperature of the coolant flowing into the electric water pump 35, i.e., inlet coolant temperature is placed between the flow control valve 30 and the electric motor 35 in the outlet passage 12. A second coolant temperature sensor 42 for measuring the temperature of the coolant flowing into the flow control valve 30 is placed near the flow control valve 30 connected to the bypass passage 13. A third coolant temperature sensor 43 for measuring the temperature of the coolant flowing into the flow control valve 30 is placed between the radiator 20 and the flow control valve 30 in the outlet passage 12.

The engine 10 is provided with a crankshaft position sensor (engine speed sensor) 15 for detecting a crankshaft rotation position and measuring engines speed. A throttle valve 17 is placed in an intake pipe 16. A throttle position sensor 18 measures the position of the throttle valve 17. An intake pressure sensor 19 for measuring intake pressure, i.e., load, is disposed downstream the throttle valve 17.

The coolant for cooling the engine 10 flows along a route indicated by blank arrows in FIG. 1. The electric water pump 35 forces the coolant through the outlet passage 12 into the engine 10. The coolant circulated through the engine 10 flows through the inlet passage 11 into the radiator 20. The coolant is cooled as it flows through the radiator 20, and then the thus cooled coolant is supplied through the outlet passage 12 into the engine 10 at a flow rate determined by the valve opening of the flow control valve 30. Part of the coolant flowing through the inlet passage 11 is returned through the bypass passage 13 into the engine 10 so that the coolant of a predetermined temperature is supplied into the engine 10.

An electronic control unit (ECU) 60 receives an intake pressure signal (PM) provided by the intake pressure sensor 19, an engine speed signal (NE) provided by the engine speed sensor 15, a valve opening signal (VO) provided by the potentiometer 31, a first coolant temperature signal (T1) provided by the first coolant temperature sensor 41, a second coolant temperature signal (T2) provided by the second coolant temperature sensor 42, a third coolant temperature signal (T3) provided by the third coolant temperature sensor 43, a vehicle speed signal (SPD) provided by the vehicle speed sensor 51, a gear ratio signal (GR) provided by a gear ratio sensor 52, an automatic transmission control signal (AT) provided by an AT controller 53, an atmospheric pressure signal (PA) provided by an atmospheric pressure sensor 54, a humidity signal (HD) provided by a humidity sensor 55, an intake temperature signal (TIN) provided by an intake temperature sensor 56, and an ambient temperature signal (TAM) provided by an ambient temperature sensor 57.

The ECU 60 is an arithmetic/logic unit comprising a CPU 6, i.e., a generally known central processing unit capable of carrying out various arithmetic operations, a ROM 62 storing control programs and control data in the map form, a RAM 63 for storing data, a backup RAM 64, an I/O circuit 65 and bus lines 66 connecting those components. The ECU 60 controls the flow control valve 30, the electric pump 35 and the electric motor 22 on the basis of the signals provided by the sensors.

A coolant temperature control routine carried out by the CPU 61 of the ECU 60 will be described with reference to a flow chart shown in FIG. 2. The valve opening of the flow control valve 30 is controlled to control coolant temperature. The CPU 61 repeats the coolant temperature control routine at a predetermined period.

Figure 2:
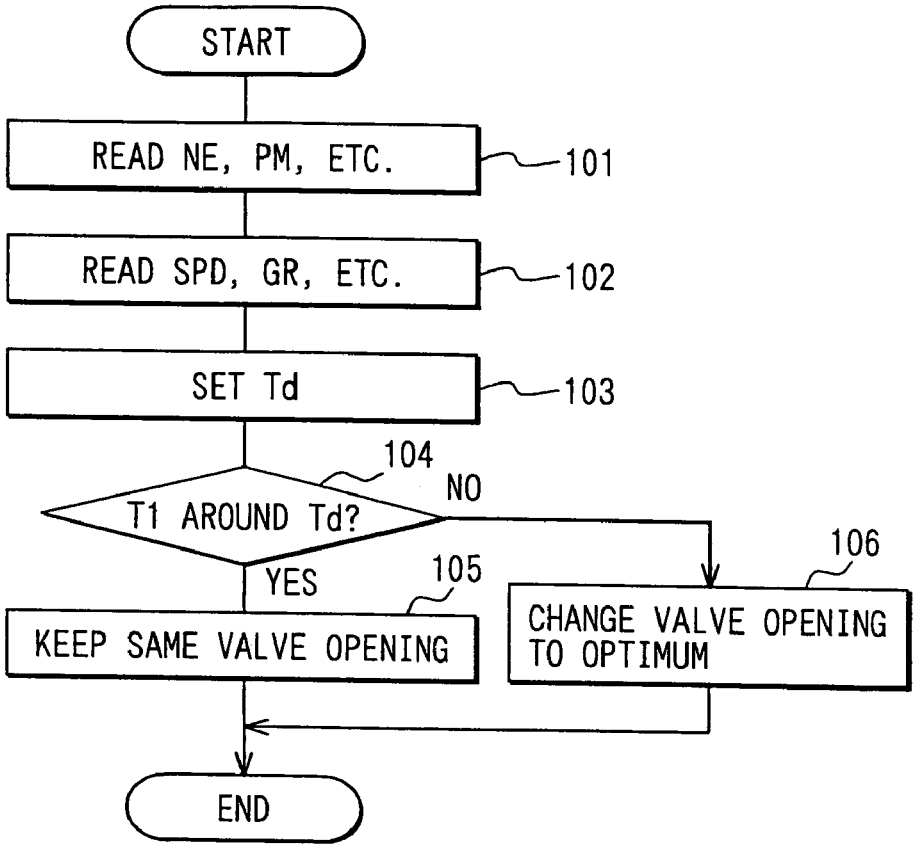
FIG. 2 is a flow chart of a coolant temperature control routine carried out in the first embodiment.

Referring to FIG. 2, the ECU 60 receives the engine speed signal NE, i.e., a signal indicating the operating condition of the engine 10, provided by the engine speed sensor 15, the intake pressure signal PM, i.e., a signal indicating load on the engine 10, provided by the intake pressure sensor 19, and the first, second and third coolant temperature signals T1, T2 and T3 provided by the coolant temperature sensors 41, 42 and 43 at step 101. Further, the ECU 60 receives the vehicle speed signal SPD, provided by the vehicle speed sensor 51, the gear ratio signal GR provided by the gear ratio sensor 52 or the AT control signal provided by the AT controller 53 as traveling mode information, or the atmospheric pressure signal PA provided by the atmospheric pressure sensor 54, the humidity signal HD provided by the humidity sensor 55 or the intake temperature signal TIN provided by the intake temperature sensor 56 as an ambient condition information at step 102.

Then, a desired coolant temperature Td is set according to the operating condition of the engine 10 and the raveling mode, or the ambient condition at step 103. Then, a check is made at step 104 to determine if the coolant temperature T1 at the inlet of the electric water pump 35, i.e., a coolant temperature of the coolant to be pumped into the engine 10, is within a predetermined range around the desired coolant temperature Td set in the step 103. If the result of check made at step 104 is affirmative, i.e., if the coolant temperature is within the predetermined range around the desired coolant temperature, the routine moves to step 105. At step 105, the valve opening of the flow control valve 30 is kept unchanged, and then the routine is ended.

If the result of check made at step 104 is negative, i.e., the coolant temperature is outside the predetermined range around the desired coolant temperature, the routine moves to step 106. An optimum valve opening for adjusting the coolant temperature to the desired coolant temperature is calculated and a valve opening signal representing the calculated optimum valve opening is given to the flow control value 30 at step 106, and then the routine is ended.

The cooled coolant flowing through the inleT1assage 11 and cooled by the radiator 20 and the uncooled coolant flowing through the bypass passage 13 bypassing the radiator 20 are mixed in the flow control valve 30 controlled by the ECU 60 on the basis of the signals provided by the potentiometer 31, the coolant temperature sensors 41, 42 and 43, and the mixed coolant is pumped into the engine 10 by the electric water pump 35 placed in the outlet passage 12. Since the desired coolant temperature is variable according to the operating condition of the engine 10, the traveling mode and the ambient condition, the engine 10 is able to operate efficiently and fuel consumption can be reduced.

(Second Embodiment)

A traveling mode determining routine shown in FIG. 3 and a coolant temperature control routine shown in FIG. 4 carried out in the second embodiment will be described. The CPU 61 repeats the traveling mode determining routine and the coolant temperature control routine at a predetermined period.

Figure 3:
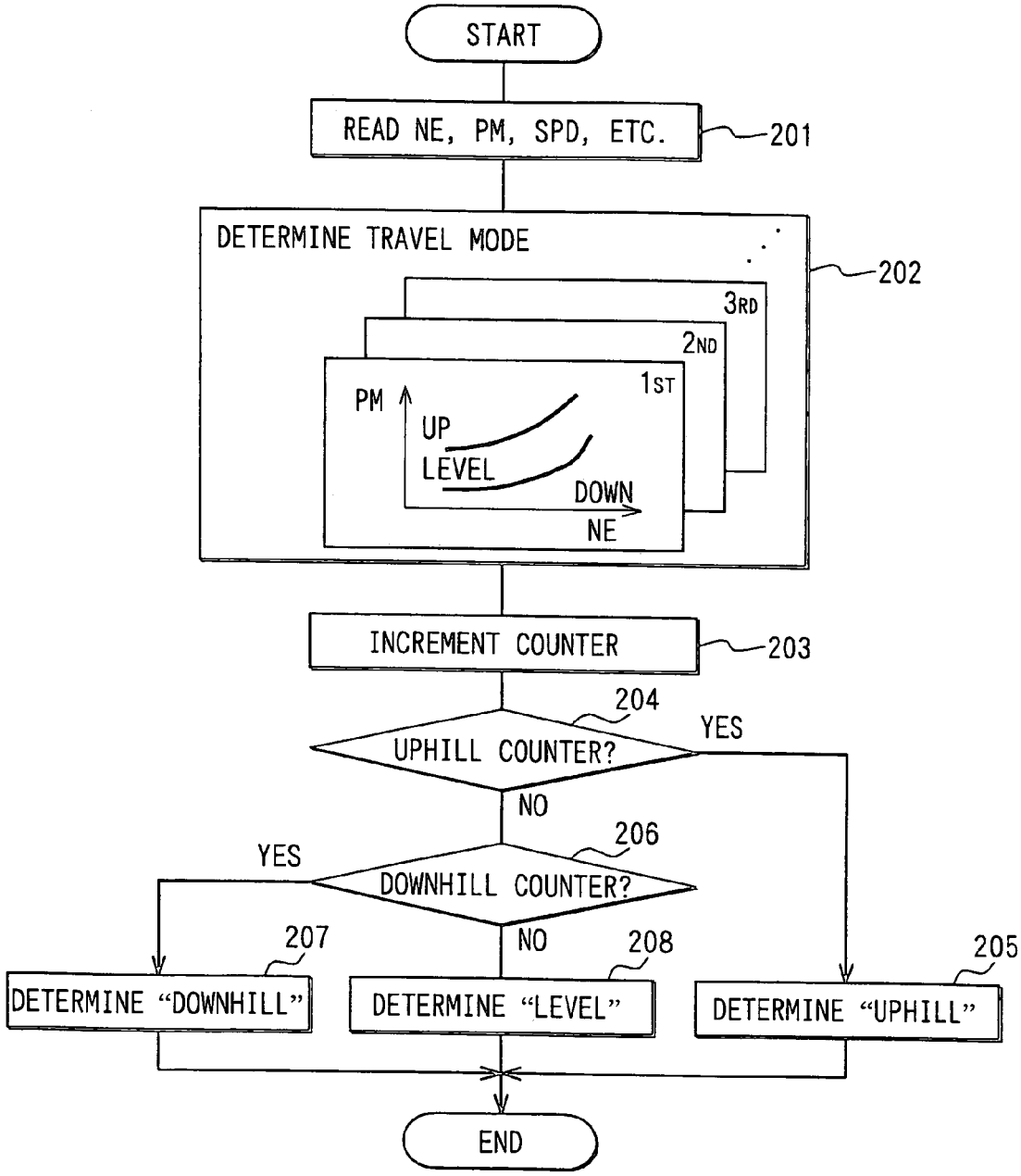
FIG. 3 is a flow chart of a traveling mode determining routine carried out in the second embodiment.

Referring to FIG. 3, the ECU 60 receives the engine speed signal NE, i.e., a signal indicating the operating condition of the engine 10, provided by the engine speed sensor 15, the intake pressure signal PM, i.e., a signal indicating load on the engine 10, provided by the intake pressure sensor 19, and the vehicle speed signal SPD provided by the vehicle speed sensor 51 or the AT control signal AT provided by an AT controller 53 at step 201. At step 202, a traveling mode, i.e., an uphill traveling mode, a downhill traveling mode or a level traveling mode, is determined from maps stored in the ROM 62 by using the engine speed signal, the intake pressure signal and the gear ratio signal received at step 201 as parameters. The traveling mode of the vehicle may be determined on the basis of information provided by the AT controller, i.e., traveling mode information.

Then, an uphill counter, a downhill counter or a level counter is incremented every predetermined time at step 203. A check is made at step 204 to determine if the count of the uphill counter while the vehicle is in the uphill traveling mode is greater than a threshold. If the result of check made at step 204 is affirmative, i.e., if the count of the uphill counter is greater than the threshold, it is determined that the vehicle is in the uphill traveling mode at step 205.

If the result of check made at step 204 is negative, i.e., if the count of the uphill counter is not greater than the threshold, a check is made at step 206 to determine if the count of the downhill counter when the vehicle is in the downhill traveling mode is greater than a threshold. If the result of check made at step 206 is affirmative, i.e., the count of the downhill counter is greater than the threshold, it is determined at step 207 that the vehicle is in the uphill traveling mode and the routine is ended. If the result of check made at step 206 is negative, i.e., if the count of the downhill counter is not greater than the threshold, it is determined at step 208 that the vehicle is in the level traveling mode and then the routine is ended.

Figure 4:
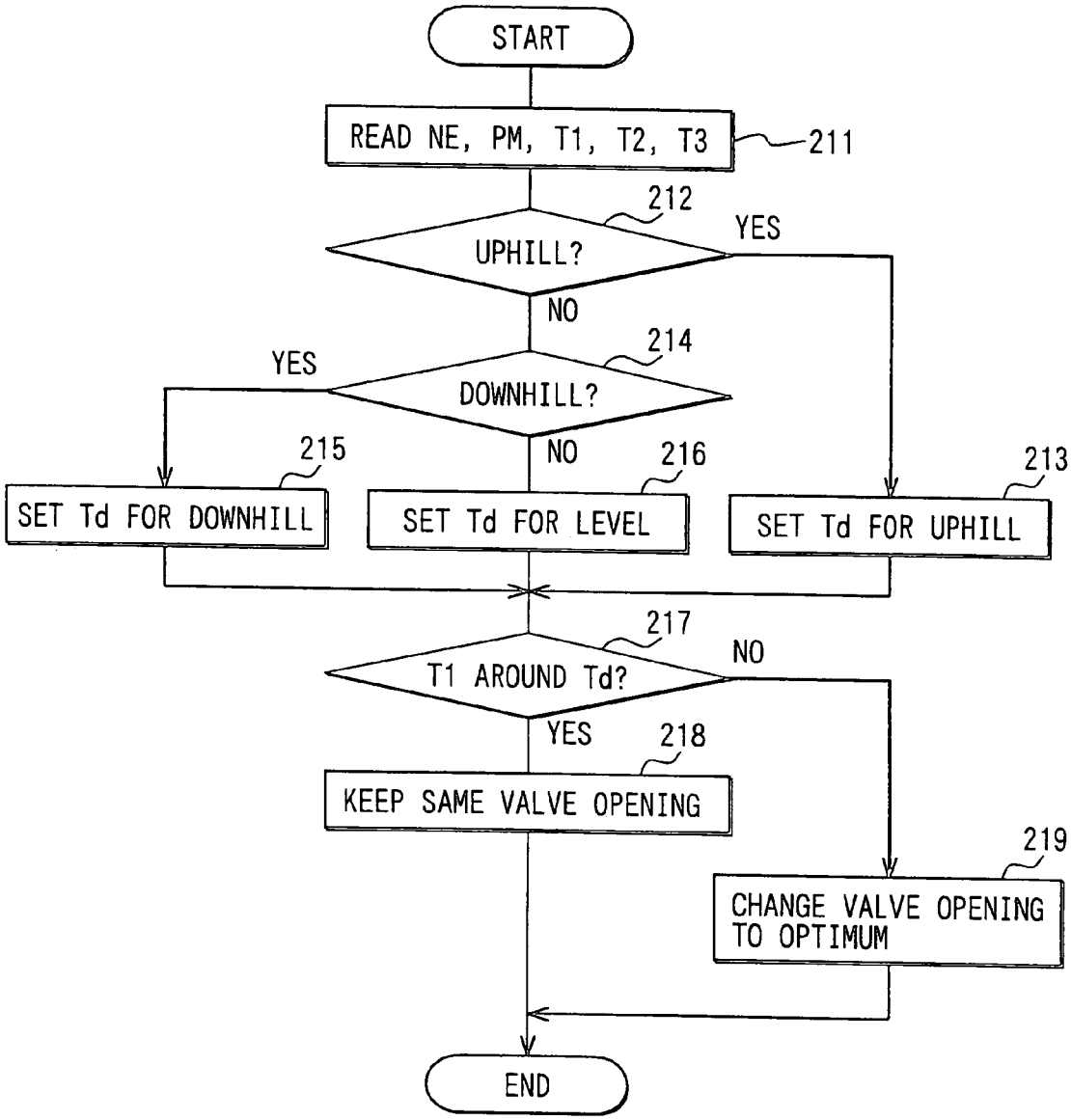
FIG. 4 is a flow chart of a coolant temperature control routine carried out according to the determination of a traveling mode.

Referring to FIG. 4, the ECU 60 receives the engine speed signal NE, i.e., a signal indicating the operating condition of the engine 10, provided by the engine speed sensor 15, the intake pressure signal PM, i.e., a signal indicating load on the engine 10, provided by the intake pressure sensor 19, and first, second and third coolant temperature signals T1, T2 and T3 provided by the coolant temperature sensors 41, 42 and 43 at step 211. Then, a check is made at step 212 to determine if the traveling mode determining routine shown in FIG. 3 determined that the vehicle is in the uphill traveling mode.

If the result of check made at step 212 is affirmative, i.e., if the vehicle is in the uphill traveling mode, the desired coolant temperature Td for the uphill traveling mode is set at step 213. The desired coolant temperature for the uphill traveling mode is lower than a normal desired coolant temperature for the level traveling mode because it is expected that the continuous load on the engine 10 and coolant temperature rise in the uphill traveling mode are greater than those in the level traveling mode.

If the result of check made at step 212 is negative, i.e., if the vehicle is not in the uphill traveling mode, a check is made at step 214 to determine if the traveling mode determining routine shown in FIG. 3 determined that the vehicle is in the downhill traveling mode. If the result of check made at step 214 is affirmative, i.e., if the vehicle is in the downhill traveling mode, the desired coolant temperature Td for the downhill traveling mode is determined at step 215. The desired coolant temperature for the downhill traveling mode including a deceleration mode is higher than the normal desired coolant temperature for the level traveling mode because it is expected that the continuous load on the engine 10 and coolant temperature rise in the downhill traveling mode are smaller than those in the level traveling mode. The higher desired coolant temperature is effective in further reducing frictional resistance. If the result of check made at step 214 is negative, i.e., if the vehicle is not in the downhill traveling mode, the normal desired coolant temperature for the level traveling mode is determined at step 216.

A check is made at step 217 to determine if inlet coolant temperature T1 at the inlet of the electric water pump 35 is within a predetermined range around the desired coolant temperature Td determined at step 213, 215 or 216. If the result of check made at step 217 is affirmative, i.e., if the inlet coolant temperature is within the predetermined range around the desired coolant temperature, the valve opening of the flow control valve 30 is kept unchanged at step 218, and then the routine is ended. If the result of check made at step 217 is negative, i.e., the inlet coolant temperature is outside the predetermined range around the desired coolant temperature, the optimum valve opening to adjust the inlet coolant temperature to the desired coolant temperature is calculated and a valve opening signal representing the calculated optimum valve opening is given to the flow control valve 30 at step 219, and then the routine is ended. The optimum valve opening may be calculated based on various parameter values read in at step 211.

(Third Embodiment)

A steady/transient traveling state determining routine shown in FIG. 5 and a coolant temperature control routine shown in FIG. 6 carried out by the ECU 60 in the third embodiment will be described. The CPU 61 repeats the steady/transient traveling state determining routine and the coolant temperature control routine at a predetermined period.

Figure 5:
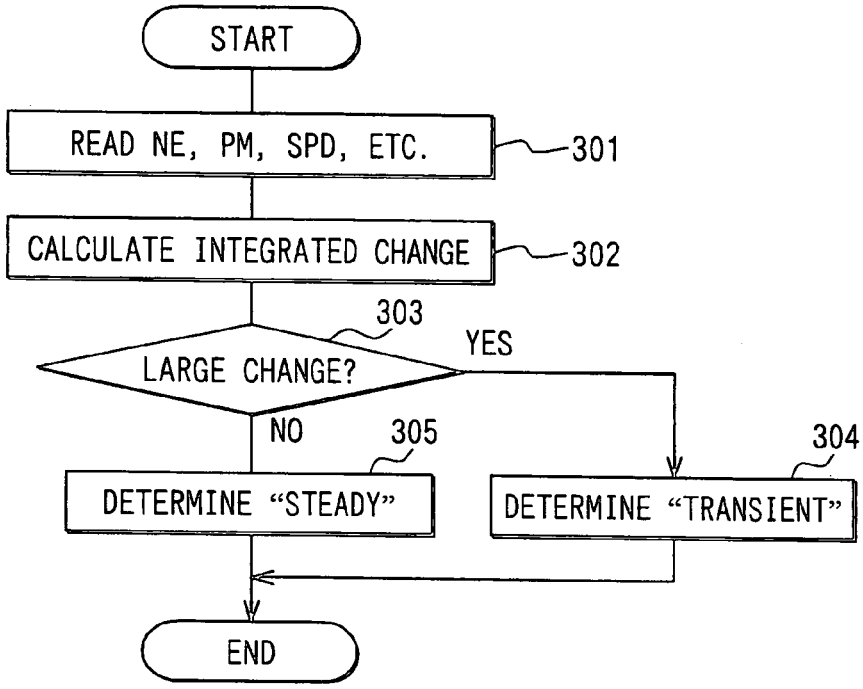
FIG. 5 is a flow chart of a steady/transient traveling state determining routine carried out in the third embodiment.

Referring to FIG. 5, the ECU 60 receives the engine speed signal NE, i.e., a signal indicating the operating condition of the engine 10, provided by the engine speed sensor 15, the intake pressure signal PM, i.e., a signal indicating load on the engine 10, provided by the intake pressure sensor 19, and the vehicle speed signal SPD provided by the vehicle speed sensor 51 or the AT control signal AT provided by the AT controller 53 at step 301. Then, at step 302, an integrated change of loads (intake pressure, throttle opening and amount of intake air) on the engine 10 or an integrated change of engine speed is calculated for steady/transient traveling state determination. A check is made at step 303 to determine if the integrated change calculated at step 302 is larger than a predetermined value.

If the result of check made at step 303 is affirmative, i.e., if the integrated change is larger than the predetermined value, it is determined at step 304 that the vehicle is traveling in a transient traveling state, and then the routine is ended. If the result of check made at step 303 is negative, i.e., if the integrated change is less than the predetermined value, it is determined at step 305 that the vehicle is traveling in a steady traveling state, and then the routine is ended.

Figure 6:
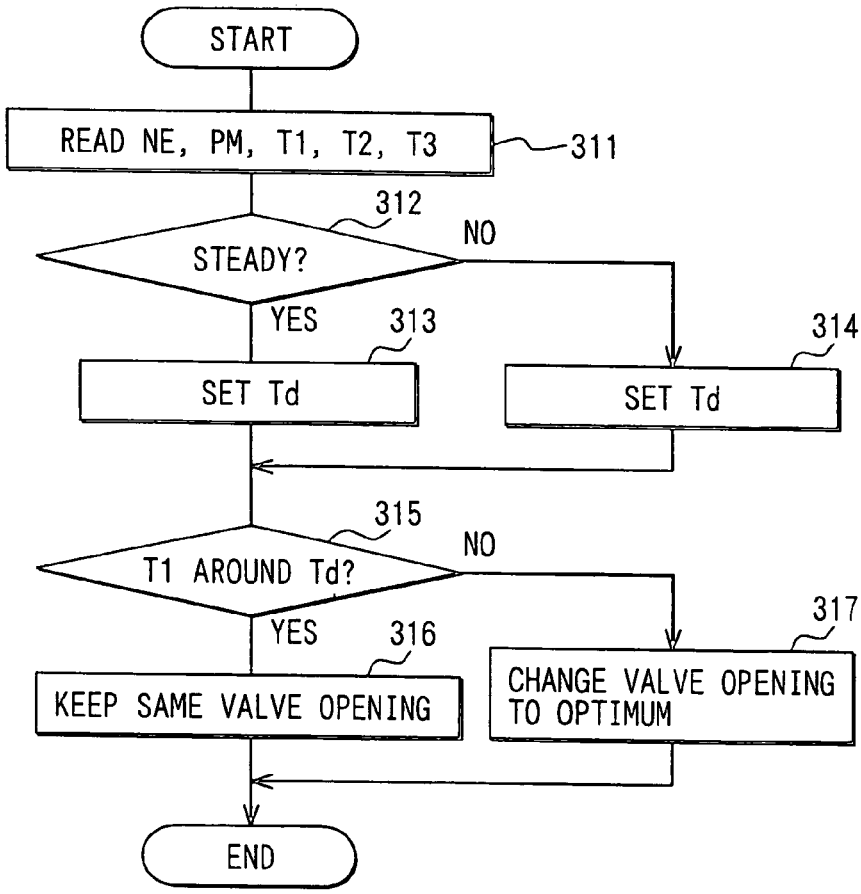
FIG. 6 is a flow chart of a coolant temperature control routine carried out according to the determination made by the steady/stationary traveling state determining routine.

Referring to FIG. 6, the ECU 60 receives the engine speed signal NE, i.e., a signal indicating the operating condition of the engine 10, provided by the engine speed sensor 15, the intake pressure signal PM, i.e., a signal indicating load on the engine 10, provided by the intake pressure sensor 19, and the first, second and third coolant temperature signals T1, T2 and T3 provided by the coolant temperature sensors 41, 42 and 43 at step 311. Then, a check is made at step 312 to determine if the steady/transient traveling state determining routine shown in FIG. 5 determined that the vehicle is in the steady traveling state.

If the result of check made at step 312 is affirmative, i.e., if the vehicle is in the steady traveling state, a normal desired coolant temperature for the steady traveling state is set at step 313. If the result of check made at step 312 is negative, i.e., if the vehicle is in the transient traveling state, a desired coolant temperature for the transient traveling state is set at step 314. The desired coolant temperature for the transient traveling state is lower than that for the steady traveling state because load varies in a wide range and detonation tends to occur in the transient traveling state. Then, a check is made at step 315 to determine if the inlet coolant temperature T1 at the inlet of the electric water pump 35 is within a predetermined range around the desired coolant temperature Td set at step 313 or 314.

If the result of check made at step 315 is affirmative, i.e., if the inlet coolant temperature is within the pre-determined range around the desired coolant temperature, the valve opening of the flow control valve 30 is kept unchanged at step 316, and then the routine is ended. If the result of check made at step 315 is negative, i.e., if the inlet coolant temperature is outside the predetermined range around the desired coolant temperature, an optimum valve opening to adjust the inlet coolant temperature to the desired coolant temperature is calculated and a valve opening signal representing the calculated optimum valve opening is given to the flow control valve 30 at step 317, and then the routine is ended.

(Fourth Embodiment)

An altitude level determining routine shown in FIG. 7 and a coolant temperature control routine shown in FIG. 8 carried out by the ECU 60 in the fourth embodiment will be described. The CPU 61 repeats the altitude level determining routine and the coolant temperature control routine at a predetermined period.

Figure 7:
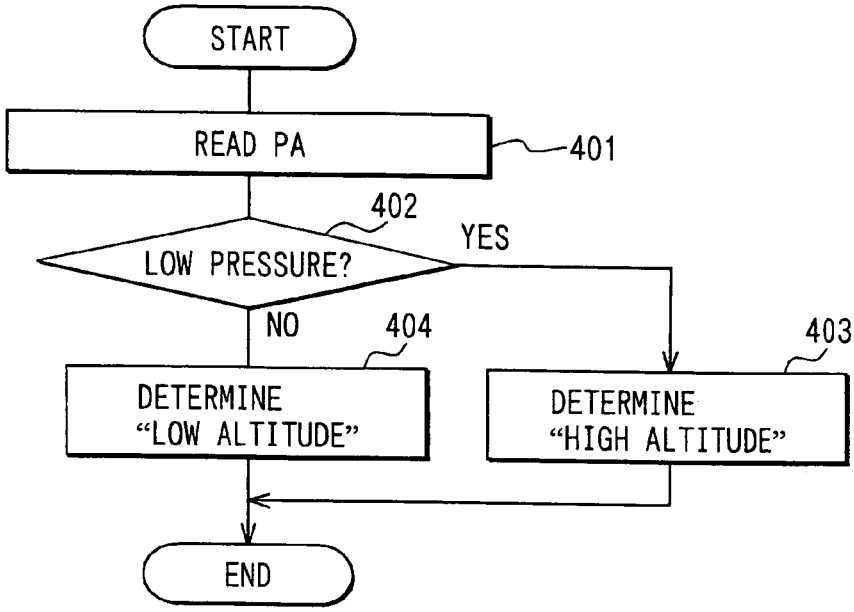
FIG. 7 is a flow chart of an altitude level determining routine carried out in the fourth embodiment.

Referring to FIG. 7, the ECU 60 receives the atmospheric pressure signal PA provided by the atmospheric pressure sensor 54 or the engine speed signal NE provided by the engine speed sensor 15, the intake pressure signal PM provided by the intake pressure sensor 19, and the throttle position signal TA provided by the throttle position sensor 18 at step 401. The atmospheric pressure PA is represented by the atmospheric pressure signal provided by the atmospheric pressure sensor 54 when the internal combustion engine cooling system is provided with the atmospheric pressure sensor 54. The atmospheric pressure can be estimated from intake pressure at the start of the engine 10 or from intake pressure in a state where the engine speed is not higher than a predetermined level and the throttle opening is not smaller than a predetermined throttle opening, if the internal combustion engine cooling system is noT1rovided with the atmospheric pressure sensor 54.

A check is made at step 402 to determine if the atmospheric pressure measured at step 401 is lower than a predetermined pressure. If the result of check made at step 402 is affirmative, i.e., if the atmospheric pressure is lower than the predetermined pressure, it is determined that the vehicle is at a high altitude at step 403, and then the routine is ended. If the result of check made at step 402 is negative, i.e., if the atmospheric pressure is higher than the predetermined pressure, it is determined that the vehicle is at a low altitude at step 404 and then the routine is ended.

Figure 8:
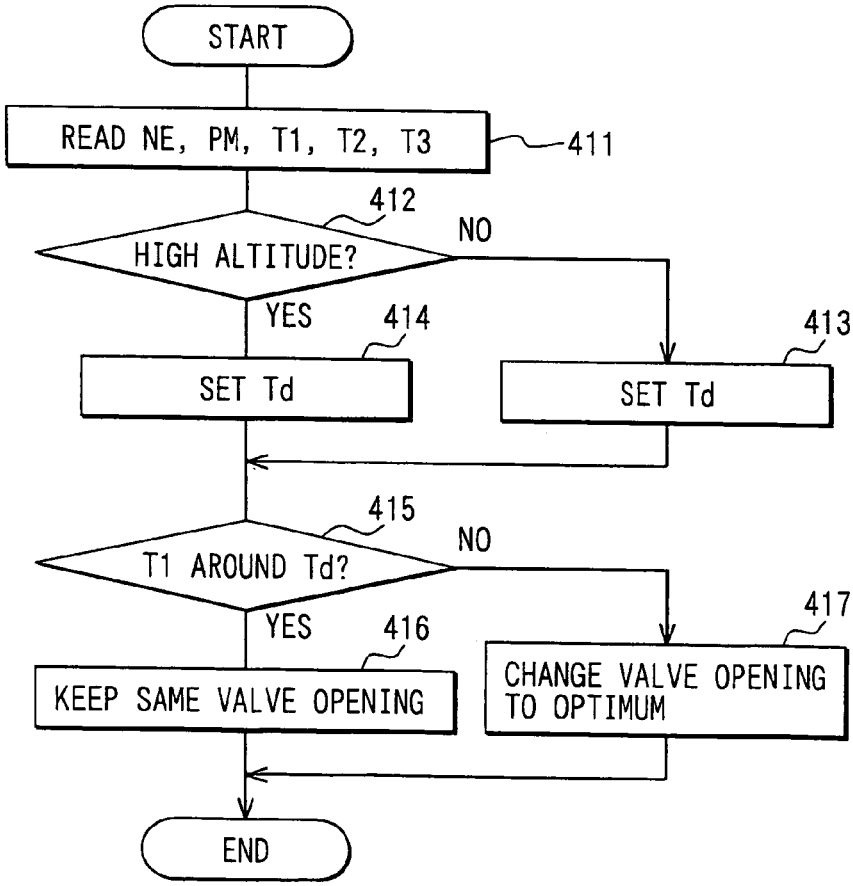
FIG. 8 is a flow chart of a coolant temperature control routine carried out according to an altitude level determined by the altitude level determining routine shown in FIG. 7.

Referring to FIG. 8, the ECU 60 receives the engine speed signal NE, i.e., a signal indicating the operating condition of the engine 10, provided by the engine speed sensor 15, the intake pressure signal PM, i.e., a signal indicating load on the engine 10, provided by the intake pressure sensor 19, and the first, second and third coolant temperature signals T1, T2 and T3 provided by the coolant temperature sensors 41, 42 and 43 at step 411. Then, a check is made at step 412 to determine if the altitude level determining routine determined that the vehicle is at a high altitude.

If the result of check made at step 412 is affirmative, i.e., if the vehicle is at a high altitude, a desired coolant temperature for high altitude is determined at step 413. The atmospheric pressure is low, exhaust pressure is low and the charging efficiency of the engine 10 is high at high altitudes. Consequently, the possibility of detonation at high altitudes is higher than that at low altitudes. Therefore, the desired coolant temperature Td for high altitudes is lower than that for low altitudes. If the result of check made at step 412 is negative, i.e., if the vehicle is at a low altitude, a normal desired coolant temperature for a low altitude level is determined at step 414.

Then, a check is made at step 415 to determine if inlet coolant temperature T1 at the inlet of the electric water pump 35 is in a predetermined range around the desired coolant temperature set at step 413 or 414. If the result of check made at step 415 is affirmative, i.e., if the inlet coolant temperature is within the predetermined range around the desired coolant temperature, the valve opening of the flow control valve 30 is kept unchanged at step 416, and then the routine is ended. If the result of check made at step 415 is negative, i.e., if the inlet coolant temperature is outside the predetermined range around the desired coolant temperature, an optimum valve opening to adjust the inlet coolant temperature to the desired coolant temperature is calculated and a valve opening signal representing the calculated optimum valve opening is given to the flow control valve 30 at step 417, and then the routine is ended.

(Fifth Embodiment)

An atmospheric pressure measuring routine shown in FIG. 9 and a coolant temperature control routine shown in FIG. 10 carried out by the ECU 60 in the fifth embodiment will be described. The CPU 61 repeats the atmospheric pressure measuring routine and the coolant temperature control routine at a predetermined period.

Figure 9:
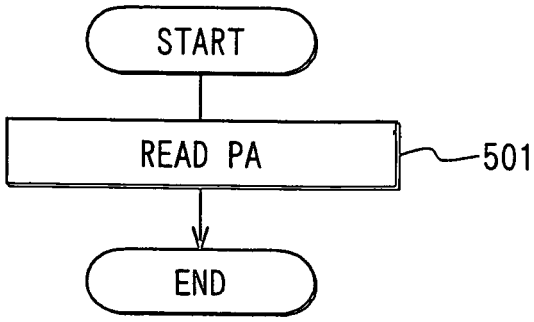
FIG. 9 is a flowchart of an atmospheric pressure measuring routine carried out in the fifth embodiment.

Referring to FIG. 9, the ECU 60 receives the atmospheric pressure signal PA provided by the atmospheric pressure sensor 54 or the engine speed signal NE provided by the engine speed sensor 15, i.e., information about atmospheric pressure, the intake pressure signal PM provided by the intake pressure sensor 19 and the throttle position signal provided by the throttle position sensor 18 at step 501, and then the routine is ended.

Figure 10:
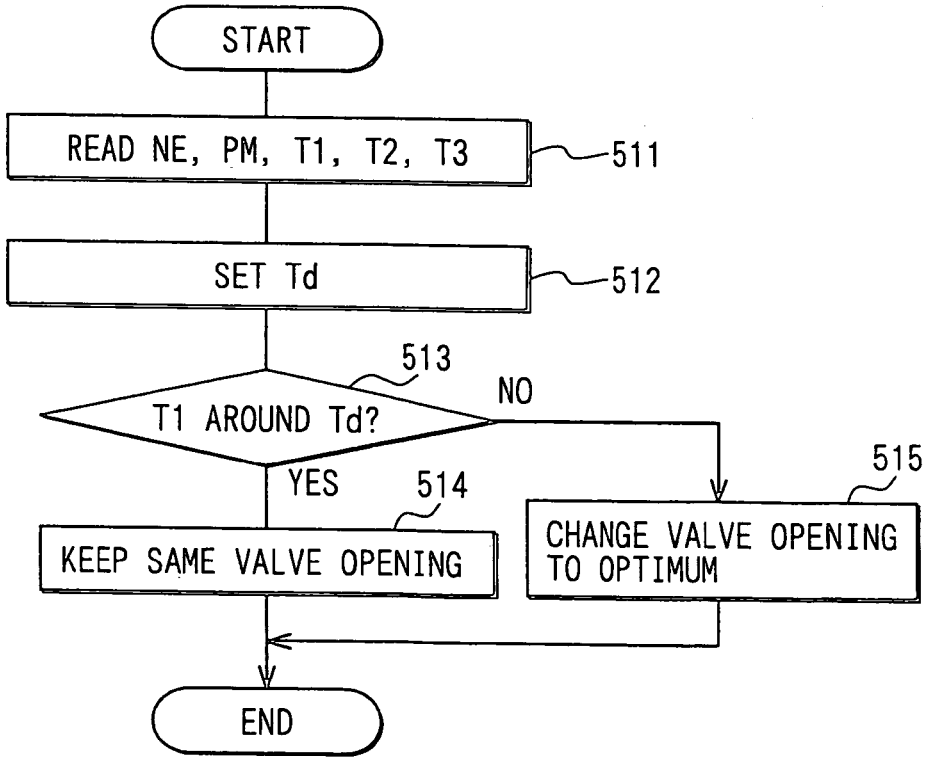
FIG. 10 is a flow chart of a coolant temperature control routine carried out according to the atmospheric pressure measured by the atmospheric pressure measuring routine shown in FIG. 9.

Referring to FIG. 10, the ECU 60 receives the engine speed signal NE, i.e., a signal indicating the operating condition of the engine 10, provided by the engine speed sensor 15, the intake pressure signal PM, i.e., a signal indicating load on the engine 10, provided by the intake pressure sensor 19, and the first, second and third coolant temperature signals T1, T2 and T3 provided by the coolant temperature sensors 41, 42 and 43 at step 511. A desired coolant temperature Td is set at step 512 according to the atmospheric pressure measured by the atmospheric pressure measuring routine shown in FIG. 9. The desired coolant temperature for low atmospheric pressures is lower than the normal desired coolant temperature for high atmospheric pressures because detonation tends to occur at high altitudes where the atmospheric pressure is low.

A check is made at step 513 to determine if the inlet coolant temperature T1 at the inlet of the electric water pump 35 is within a predetermined range around the desired coolant temperature Td set at step 512. If the result of check made at step 512 is affirmative, i.e., if the inlet coolant temperature is within the predetermined range around the desired coolant temperature, the valve opening of the flow control valve 30 is kept unchanged at step 514, and then the routine is ended. If the result of check made at step 512 is negative, i.e., if the inlet coolant temperature is outside the predetermined range around the desired coolant temperature, an optimum valve opening for adjusting the coolant temperature to the desired coolant temperature is calculated and a valve opening signal representing the calculated optimum value opening is given to the flow control value 30 at step 515, and then the routine is ended.

(Sixth Embodiment)

A humidity-level determining routine shown in FIG. 11 and a coolant temperature control routine shown in FIG. 12 carried out by the ECU 60 in the sixth embodiment will be described. The CPU 61 repeats the atmospheric pressure measuring routine and the coolant temperature control routine at a predetermined period.

Figure 11:
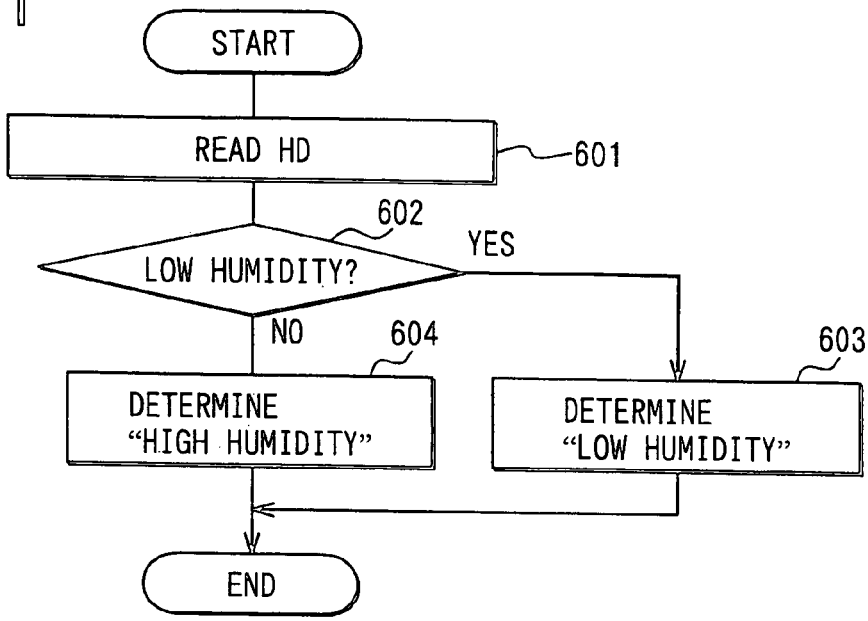
FIG. 11 is a flow chart of a humidity-level determining routine carried out in the sixth embodiment.

Referring to FIG. 11, the ECU 60 receives the humidity signal HD provided by the humidity sensor 55 at step 601. A check is made at step 602 to determine if a humidity represented by the humidity signal received at step 601 is lower than a predetermined value. If the result of check made at step 602 is affirmative, i.e., if the humidity is lower than the predetermined value, it is determined at step 603 that the humidity of the atmosphere is low, and then the routine is ended. If the result of check made at step 602 is negative, i.e., if the humidity is higher than the predetermined value, it is determined at step 604 that the humidity of the atmosphere is high, and then the routine is ended.

Figure 12:
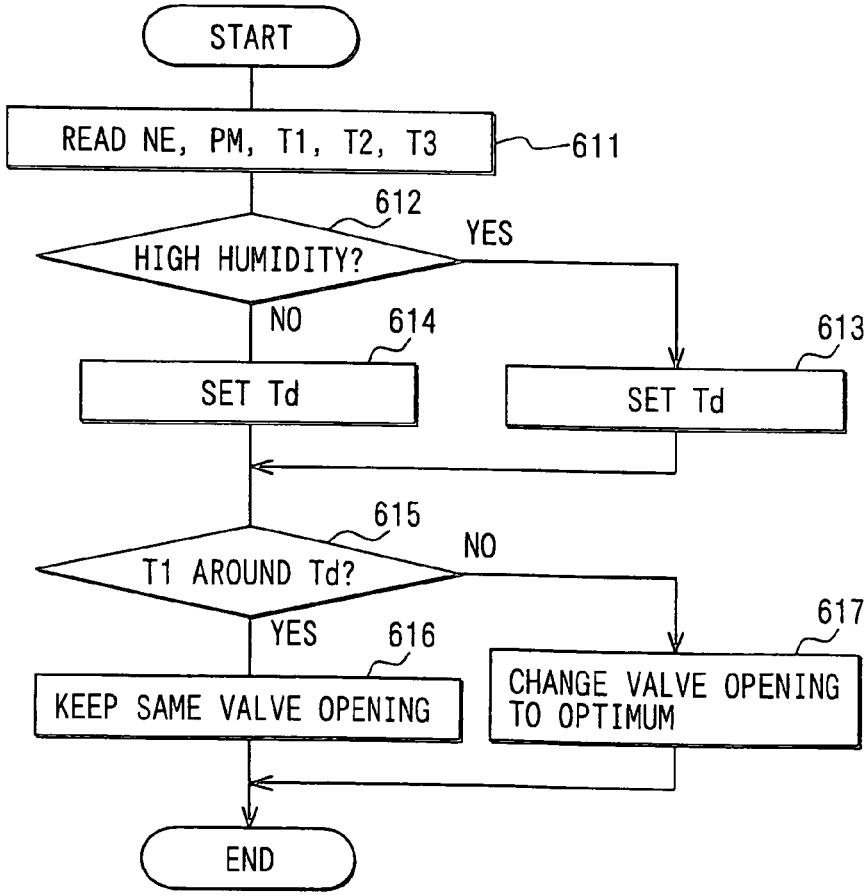
FIG. 12 is a flow chart of a coolant temperature control routine carried out according to a humidity level determined by the humidity-level determining routine shown in FIG. 11.

Referring to FIG. 12, the ECU 60 receives the engine speed signal NE, i.e., a signal indicating the operating condition of the engine 10, provided by the engine speed sensor 15, the intake pressure signal PM, i.e., a signal indicating load on the engine 10, provided by the intake pressure sensor 19, and the first, second and third coolant temperature signals T1, T2 and T3 provided by the coolant temperature sensors 41, 42 and 43 at step 611. A check is made at step 612 to determine if the humidity level determining routine shown in FIG. 11 determined that the humidity is high.

If the result of check made at step 612 is affirmative, i.e., if the humidity is high, a desired coolant temperature for the high humidity determined at step 604 is determined at step 613. It is expected that the atmosphere contains much moisture and detonation does not occur easily when the humidity is high. Therefore, the desired coolant temperature for high humidity is higher than a normal desired coolant temperature for low humidity. If the result of check made at step 612 is negative, i.e., if the humidity is low, the normal desired coolant temperature for low humidity is set at step 614.

A check is made at step 615 to determine if the inlet coolant temperature T1 at the inlet of the electric water pump 35 is within a predetermined range around the desired coolant temperature Td set at step 613 or 614. If the result of check made at step 615 is affirmative, i.e., if the inlet coolant temperature is within the predetermined range around the desired coolant temperature, the valve opening of the flow control valve 30 is kept unchanged at step 615, and then the routine is ended. If the result of check made at step 615 is negative, i.e., if the inlet coolant temperature is outside the predetermined range around the desired coolant temperature, an optimum valve opening for adjusting the coolant temperature to the desired coolant temperature is calculated and a valve opening signal representing the calculated optimum value opening is given to the flow control value 30 at step 617, and then the routine is ended.

(Seventh Embodiment)

A humidity measuring routine shown in FIG. 13 and a coolant temperature control routine shown in FIG. 14 carried out by the ECU 60 in the seventh embodiment will be described. The CPU 61 repeats the humidity measuring routine and the coolant temperature control routine at a predetermined period.

Figure 13:
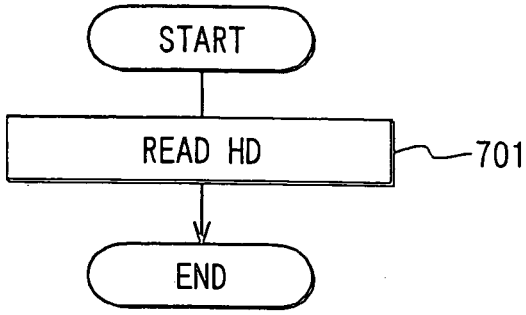
FIG. 13 is a flow chart of a humidity measuring routine carried out in the seventh embodiment.

Referring to FIG. 13, the humidity sensor 55 measures the humidity HD of the atmosphere at step 701, and then the humidity measuring routine is ended.

Figure 14:
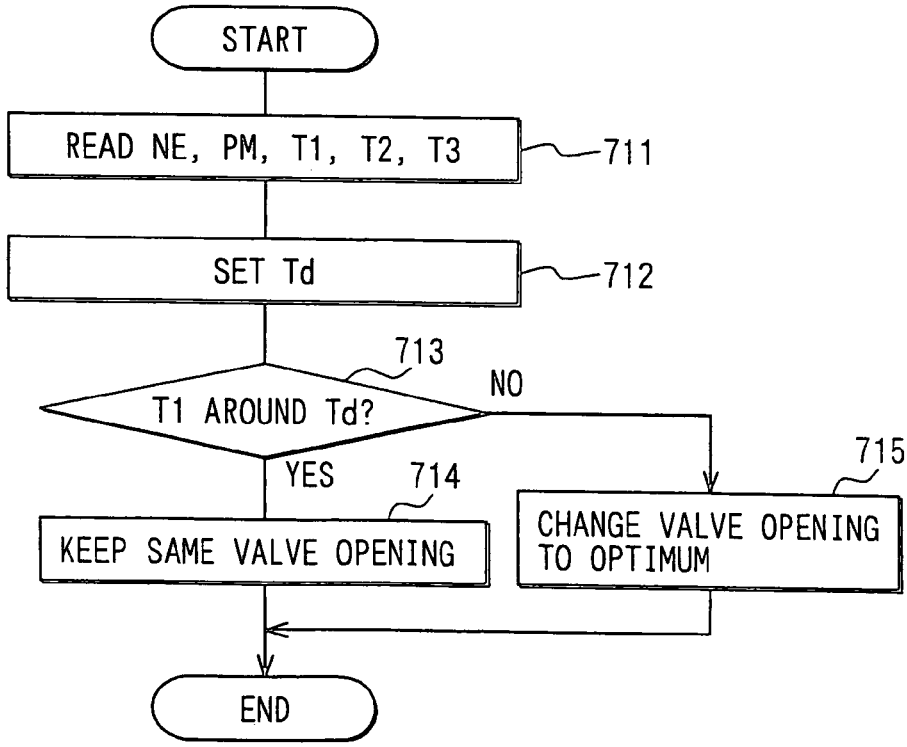
FIG. 14 is a flow chart of a coolant temperature control routine carried out according to humidity information provided by the humidity measuring routine shown in FIG. 13.

Referring to FIG. 14, the ECU 60 receives the engine speed signal NE, i.e., a signal indicating the operating condition of the engine 10, provided by the engine speed sensor 15, the intake pressure signal PM, i.e., a signal indicating load on the engine 10, provided by the intake pressure sensor 19, and the first, second and third coolant temperature signals T1, T2 and T3 provided by the coolant temperature sensors 41, 42 and 43 at step 711. Then, a desired coolant temperature Td is determined at step 712 on the basis of the humidity determined by the humidity measuring routine in FIG. 13. It is expected that the atmosphere contains much moisture and detonation does not occur easily when the humidity is high. Therefore, the desired coolant temperature for high humidity is higher than the normal desired coolant temperature for low humidity.

Then, a check is made at step 713 to determine if the inlet coolant temperature T1 is within a predetermined range around the desired coolant temperature set at step 712. If the result of check made at step 713 is affirmative, i.e., if the inlet coolant temperature T1 is within the predetermined range around the desired coolant temperature Td, the valve opening of the flow control valve 30 is kept unchanged at step 714, and then the routine is ended. If the result of check made at step 713 is negative, i.e., if the inlet coolant temperature is outside the predetermined range around the desired coolant temperature, an optimum valve opening for adjusting the coolant temperature to the desired coolant temperature is calculated and a valve opening signal representing the calculated optimum value opening is given to the flow control value 30 at step 715, and then the routine is ended.

(Eighth Embodiment)

An intake air temperature level determining routine shown in FIG. 15 and a flow chart of a coolant temperature control routine shown in FIG. 16 carried out by the ECU 60 in the eighth embodiment will be described. The CPU 61 repeats the humidity measuring routine and the coolant temperature control routine at a predetermined period.

Figure 15:
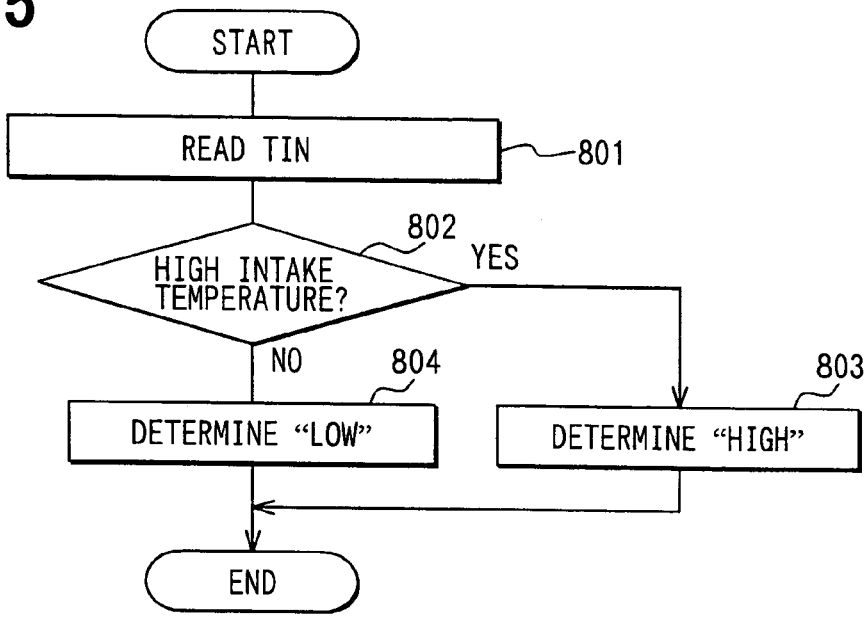
FIG. 15 is a flow chart of an intake air temperature level determining routine carried out in the eighth embodiment.

Referring to FIG. 15, the ECU 60 receives the intake temperature signal TIN provided by the intake temperature sensor 56 or the ambient temperature signal or an estimated ambient temperature signal provided by the ambient temperature sensor 57, i.e., a signal indicating information about intake temperature at step 801. Then, a check is made at step 802 to determine if the intake temperature is higher than a pre-determined value. If the result of check made at step 802 is affirmative, i.e., if the intake temperature is higher than the predetermined value, it is determined at step 803 that the intake temperature is at a high level, and then the routine is ended. If the result of check made at step 802 is negative, i.e., if the intake temperature is below the predetermined value, it is determined at step 804 that the intake temperature is at a low level, and then the routine is ended.

Figure 16:
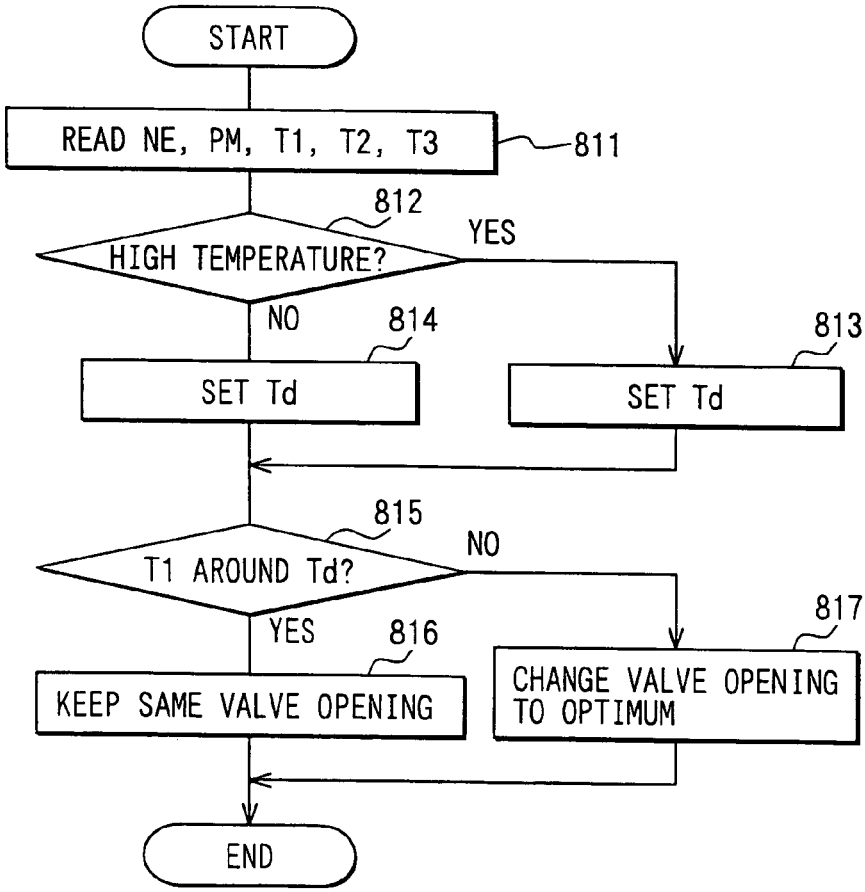
FIG. 16 is a flow chart of a coolant temperature control routine carried out according to a determination made by the intake air temperature level determining routine shown in FIG. 15.

Referring to FIG. 16, the ECU 60 receives the engine speed signal NE, i.e., a signal indicating the operating condition of the engine 10, provided by the engine speed sensor 15, the intake pressure signal PM, i.e., a signal indicating load on the engine 10, provided by the intake pressure sensor 19, and the first, second and third coolant temperature signals T1, T2 and T3 provided by the coolant temperature sensors 41, 42 and 43 at step 811. Then, a check is made at step 812 to determine if the intake air temperature level determining routine determined that the intake temperature is at a high level.

If the result of check made at step 812 is affirmative, i.e., the intake temperature is at a high level, a desired coolant temperature for high intake temperatures is set at step 813. The desired coolant temperature for high intake temperatures is lower than that for low intake temperatures because detonation tends to occur at high intake temperatures. If the result of check made at step 812 is negative, i.e., the intake temperature is at a low level, a desired coolant temperature for low intake temperatures is set at step 814. The desired coolant temperature for low intake temperatures is higher than that for high intake temperatures because detonation does not occur easily at low intake temperatures. A check is made at step 815 to determine if inlet coolant temperature T1 is within a predetermined range around the desired coolant temperature Td set in 813 or 814.

If the result of check at step 815 is affirmative, i.e., if the inlet coolant temperature is within the predetermined range around the desired coolant temperature, the valve opening of the flow control valve 30 is kept unchanged at step 816, and then the routine is ended. If the result of check at step 815 is negative, i.e., if the inlet coolant temperature is outside the predetermined range around the desired coolant temperature, an optimum valve opening for adjusting the coolant temperature to the desired coolant temperature is calculated and a valve opening signal representing the calculated optimum value opening is given to the flow control value 30 at step 817, and then the routine is ended.

(Ninth Embodiment)

An intake air temperature measuring routine shown in FIG. 17 and a coolant temperature control routine shown in FIG. 18 carried out by the ECU 60 in the ninth embodiment will be described. The CPU 61 repeats the humidity measuring routine and the coolant temperature control routine at a predetermined period.

Figure 17:
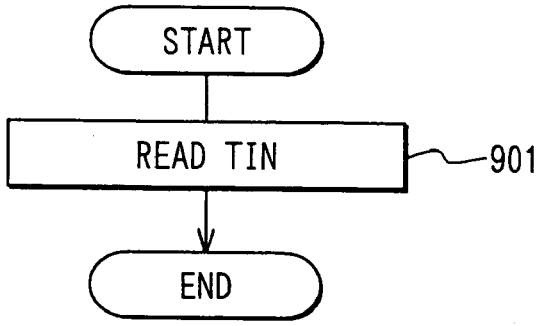
FIG. 17 is a flow chart of an intake air temperature measuring routine carried out in the ninth embodiment.

Referring to FIG. 17, the ECU 60 receives the intake temperature signal TIN provided by the intake temperature sensor 56 at step 901, and then the routine is ended.

Figure 18:
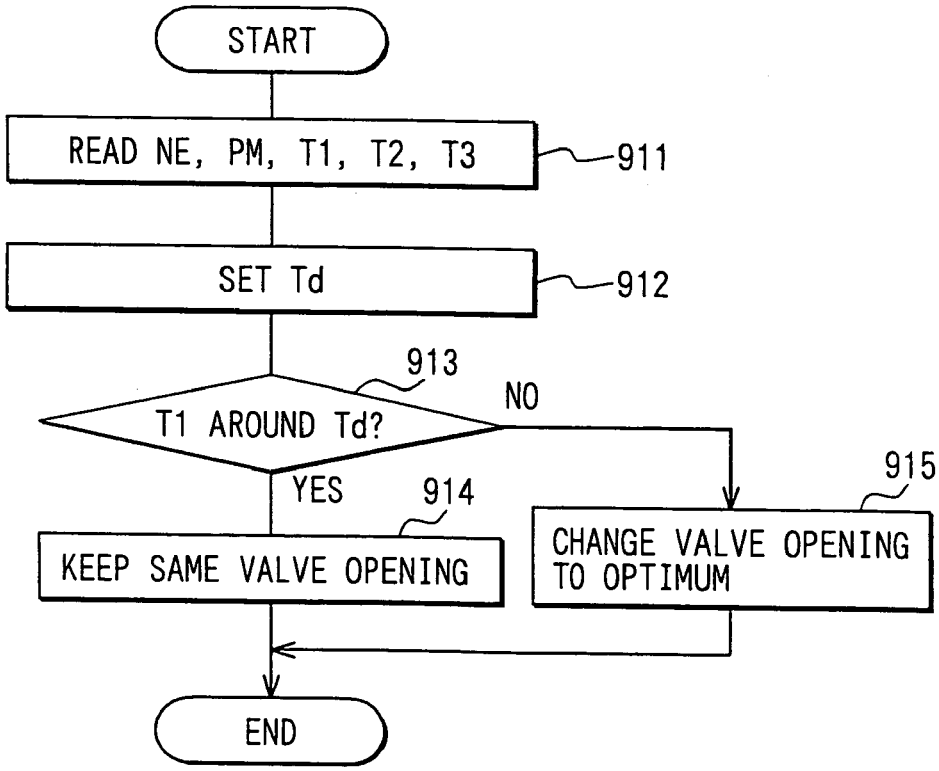
FIG. 18 is a flow chart of a coolant temperature control routine carried out according to information provided by the intake air temperature measuring routine shown in FIG. 17.

Referring to FIG. 18, the ECU 60 receives the engine speed signal NE, i.e., a signal indicating the operating condition of the engine 10, provided by the engine speed sensor 15, the intake pressure signal PM, i.e., a signal indicating load on the engine 10, provided by the intake pressure sensor 19, and the first, second and third coolant temperature signals T1, T2 and T3 provided by the coolant temperature sensors 41, 42 and 43 at step 911. Then, a desired coolant temperature Td is determined at step 912 on the basis of the intake temperature measured by the intake temperature measuring routine shown in FIG. 17. The desired coolant temperature for high intake temperatures is lower than a normal desired coolant temperature because detonation tends to occur when the intake temperature is high. A check is made at step 913 to determine if inlet coolant temperature is within a predetermined range around the desired coolant temperature set at step 912.

If the result of check made at step 913 is affirmative, i.e., the intake temperature is within the predetermined range around the desired coolant temperature, the valve opening of the flow control valve 30 is kept unchanged at step 914, and then the routine is ended. If the result of check made at step 913 is negative, i.e., if the inlet coolant temperature is outside the predetermined range around the desired coolant temperature, an optimum valve opening for adjusting the coolant temperature to the desired coolant temperature is calculated and valve opening of the flow control valve 30 is adjusted to the calculated optimum valve opening at step 915, and then a valve opening signal representing the calculated optimum value opening is given to the flow control value 30.

(Tenth Embodiment)

A coolant temperature control routine shown in FIG. 19 carried out by the ECU 60 in the tenth embodiment according to the present invention, following the determination of the mode of combustion in the engine 10 will be described. The CPU 61 repeats the humidity measuring routine and the coolant temperature control routine at a predetermined period. The engine 10 is constructed as a direct-injection engine in this embodiment.

Figure 19:
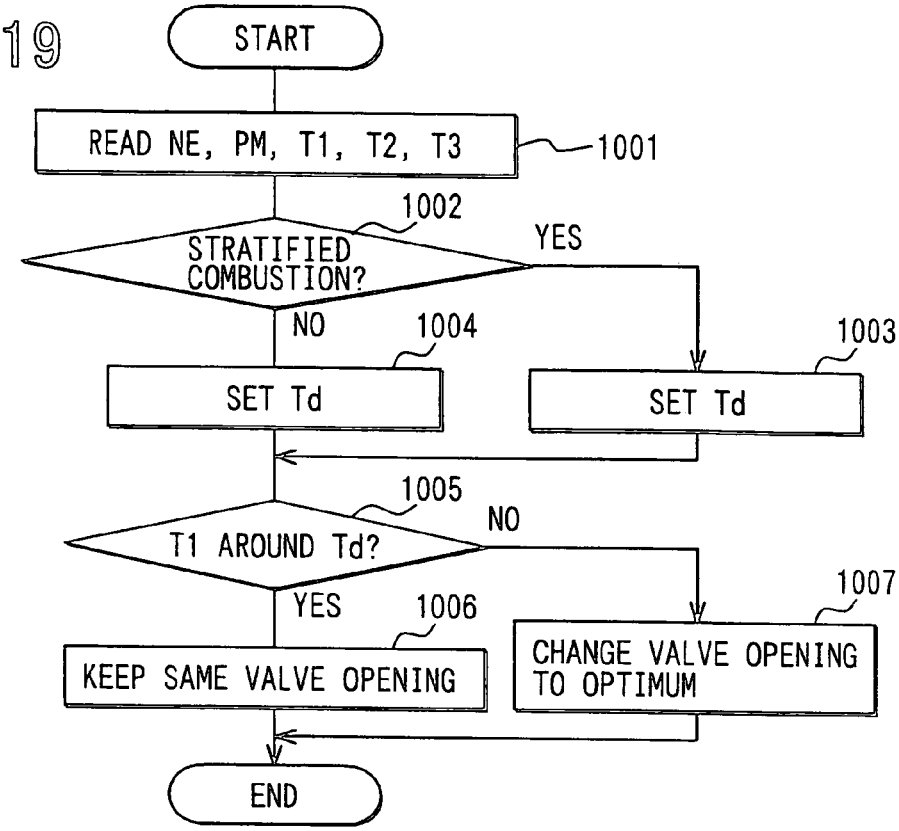
FIG. 19 is a flow chart of a coolant temperature control routine carried out in the tenth embodiment following the determination of the mode of combustion in a direct injection engine.

Referring to FIG. 19, the ECU 60 receives the engine speed signal NE, i.e., a signal indicating the operating condition of the engine 10, provided by the engine speed sensor 15, the intake pressure signal PM, i.e., a signal indicating load on the engine 10, provided by the intake pressure sensor 19, and first, second and third coolant temperature signals T1, T2 and T3 provided by the coolant temperature sensors 41, 42 and 43 at step 1001. A check is made at step 1002 to determine if the engine 10 is operating in a stratified charge combustion mode.

If the result of check made at step 1002 is affirmative, i.e., if the engine 10 is operating in the stratified charge combustion mode, a desired coolant temperature for the stratified charge combustion mode is set at step 1003. The desired coolant temperature for the stratified charge combustion mode is higher than an ordinary desired coolant temperature for a uniform charge combustion mode. If the result of check made at step 1002 is negative, i.e., if the engine 10 is operating in the uniform charge combustion mode, a desired coolant temperature for the uniform charge combustion mode is set at step 1004.

A check is made at step 1005 to determine if inlet coolant temperature at the inlet of the electric water pump 35 is within a predetermined range around the desired coolant temperature determined at step 1003 or 1004. If the result of check made at step 1005 is affirmative, i.e., if the inlet coolant temperature T1 is within the predetermined range around the desired coolant temperature Td, the valve opening of the flow control valve 30 is kept unchanged at step 1006, and then the routine is ended. If the result of check made at step 1005 is negative, i.e., the inlet coolant temperature is outside the predetermined range around the desired coolant temperature, an optimum valve opening to adjust the inlet coolant temperature to the desired coolant temperature is calculated and a valve opening signal representing the calculated optimum value opening is given to the flow control value 30 at step 1007, and then the routine is ended.

(Eleventh Embodiment)

A coolant temperature control routine shown in FIG. 20 carried out by the ECU 60 in the eleventh embodiment, following the determination of the mode of combustion in the engine 10 will be described. The CPU 61 repeats the humidity measuring routine and the coolant temperature control routine at a predetermined period. The engine 10 is constructed as a lean-burn engine in this embodiment.

Figure 20:
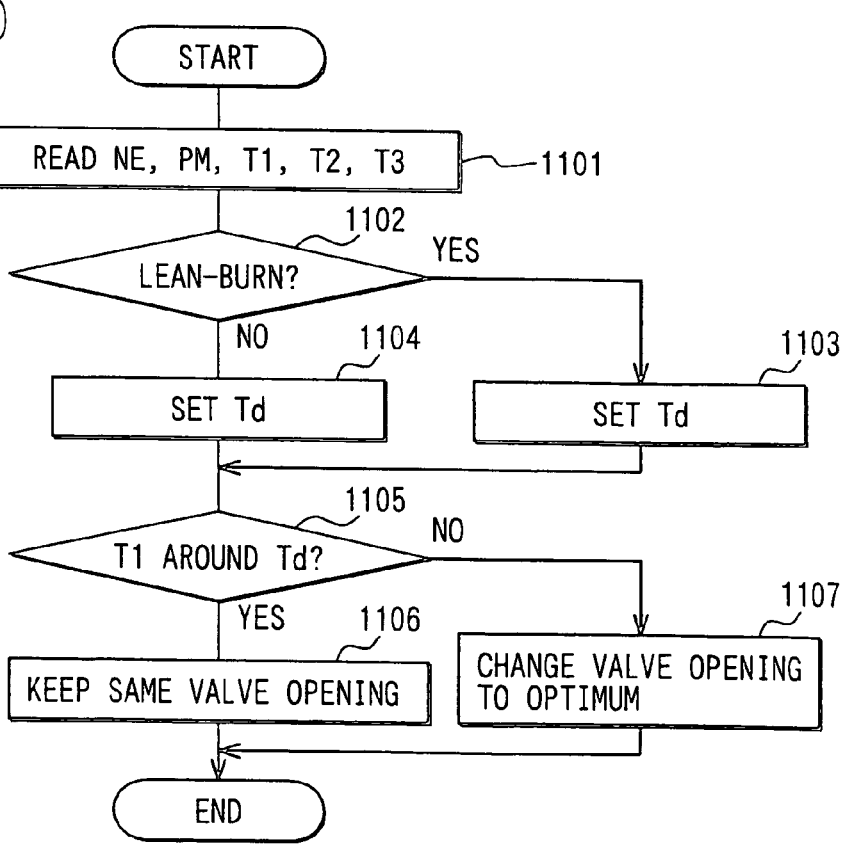
FIG. 20 is a flow chart of a coolant temperature control routine carried out in the eleventh embodiment following the determination of the mode of combustion in a lean-burn engine.

Referring to FIG. 20, the ECU 60 receives the engine speed signal NE, i.e., a signal indicating the operating condition of the engine 10, provided by the engine speed sensor 15, the intake pressure signal PM, i.e., a signal indicating load on the engine 10, provided by the intake pressure sensor 19, and the first, second and third coolant temperature signals T1, T2 and T3 provided by the coolant temperature sensors 41, 42 and 43 at step 1101. A check is made at step 1102 to determine if the engine 10 is operating in a lean-burn mode.

If the result of check made at step 1102 is affirmative, i.e., if the engine 10 is operating in the lean-burn mode, a desired coolant temperature for the lean-burn mode is set at step 1103. The desired coolant temperature for the lean-burn mode is higher than an ordinary desired coolant temperature for a stoichiometric air-fuel ratio combustion mode. If the result of check made at step 1102 is negative, i.e., if the engine 10 is operating in the stoichiometric combustion mode, a desired coolant temperature for the stoichiometric combustion mode is set at step 1104.

A check is made at step 1105 to determine if inlet coolant temperature T1 is within a predetermined range around the desired coolant temperature Td determined at step 1103 or 1104. If the result of check made at step 1105 is affirmative, i.e., if the inlet coolant temperature is within the predetermined range around the desired coolant temperature, the valve opening of the flow control valve 30 is kept unchanged at step 1106, and then the routine is ended. If the result of check made at step 1105 is negative, i.e., the inlet coolant temperature is outside the predetermined range around the desired coolant temperature, an optimum valve opening to adjust the inlet coolant temperature to the desired coolant temperature is calculated and a valve opening signal representing the calculated optimum valve opening is given to the flow control valve 30 at step 1107, and then the routine is ended.

(Twelfth Embodiment)

Figure 21:
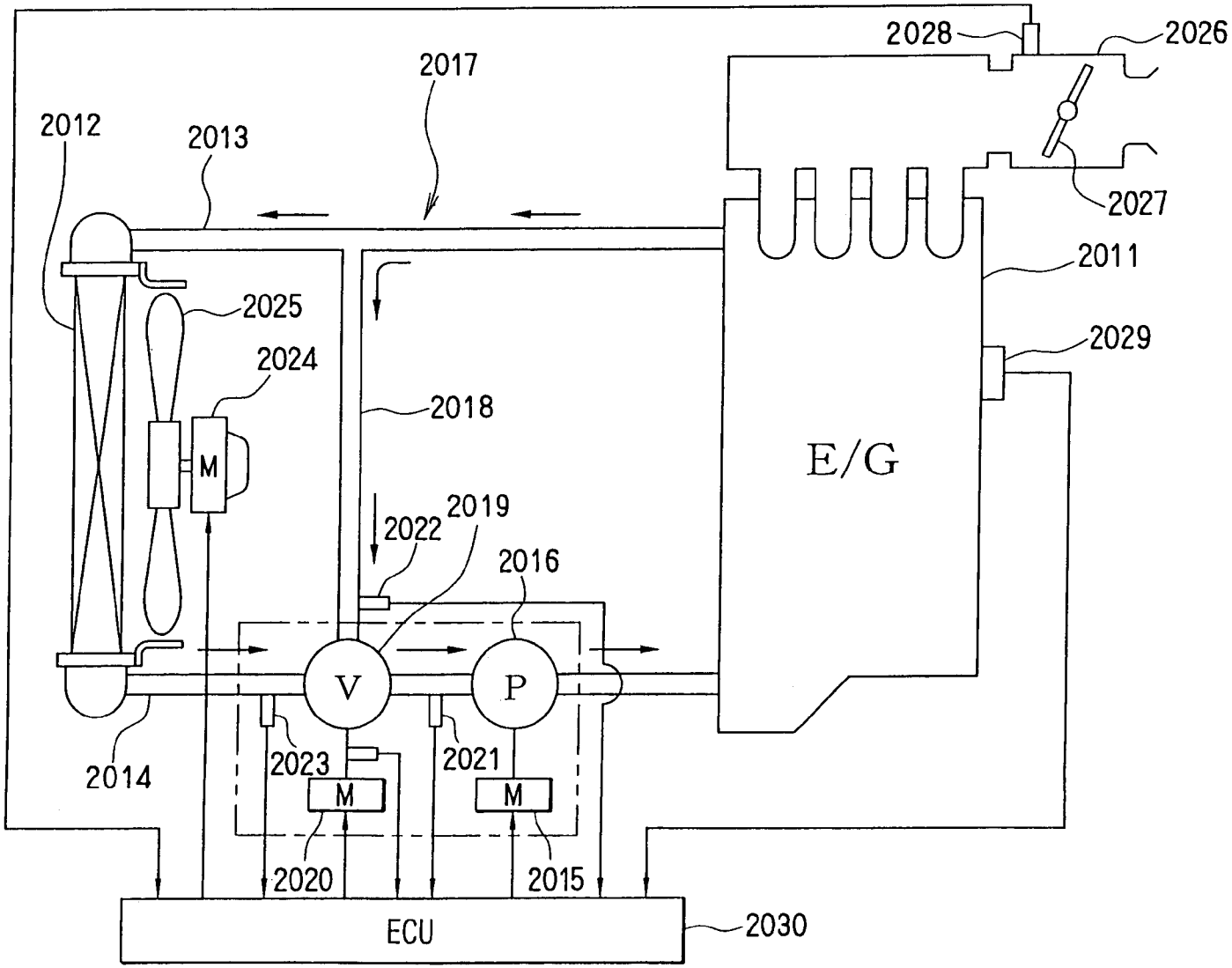
FIG. 21 is diagrammatic view of an internal combustion engine and peripheral devices to which an internal combustion engine cooling system according to the twelfth embodiment of the present invention is applied.

Referring to FIG. 21, the outlet of a water jacket formed in an internal combustion engine 2011 is connected to the inlet of a radiator 2012 through an inlet passage 2013. The outlet of the radiator 2012 is connected to the inlet of the water jacket of the engine 2011 through an outlet passage 2014. An electric water pump 2016 driven by a motor 2015 is placed in the outlet passage 2014. Thus, a coolant circulation circuit 2017, i.e., a coolant passage passing the water jacket of the engine 2011, the inlet passage 2013, the radiator 2012, the outlet passage 2014 provided with the electric water pump 2016 and the water jacket of the engine 2011 is formed in that order.

The inlet passage 2013 and the outlet passage 2014 are connected by a bypass passage 2018 extended in parallel with the radiator 2012. A rotary flow control valve 2019 is placed at the junction between the bypass passage 1018 and the outlet passage 2014. A rotary valve element, not shown, included in the flow control valve 2019 is driven by an actuator 2020, such as a motor, to control the flow rate Vb of the coolant flowing through the bypass passage 2018 (bypass flow rate Vb) and the flow rate Vr of the coolant flowing through the radiator 2012 (radiator flow rate Vr). The rotary valve element of the flow control valve 19 is set at an initial angular position to make the radiator flow rate Vr a maximum, i.e., to make the bypass flow rate Vb a minimum, or an angular position near the initial angular position by a forcing means, such as a return spring.

A first coolant temperature sensor 2021 for measuring inlet coolant temperature (pump coolant temperature) T1, i.e., the temperature of the coolant at the inlet of the electric water pump 2016, is placed in a part, on the upstream side of the electric water pump 2016, of the outlet passage 2014.

A second coolant temperature sensor 2022 for measuring the temperature T2 of the coolant flowing the bypass passage 2018 (bypass coolant temperature T2) is placed in the bypass passage 2018. A third coolant temperature sensor 2023 for measuring the temperature T3 of the coolant flowing the radiator 2012 (radiator coolant temperature T3) is placed in a part, on the upstream side of the flow control valve 2019, of the outlet passage 2014. An electric cooling fan 2025 driven by a motor 2024 is disposed near the radiator 2012.

A throttle valve 2027 is placed in an intake pipe 2026 included in the engine 2011. A dc motor or the like adjusts the angular position of the throttle valve 2027. An intake pressure sensor 28 for measuring intake pressure PM in the intake pipe 2026 is placed on the downstream side of the throttle valve 2027. An engine speed sensor 2029 is combined with the crankshaft of the engine 2011. The engine speed sensor 2029 generates a pulse every time the crankshaft turns through a predetermined angle, such as 30°. Crankshaft angles and engine speeds NE are determined on the basis of the output signal of the engine speed sensor 2029.

Output signals provided by the afore the sensors are applied to an ECU 2030. The ECU 2030 includes a microcomputer as a principal component and executes operations defined by engine control programs stored in a ROM (storage medium) to control fuel injection quantity, i.e., the quantity of fuel to be injected by a fuel injection valve, not shown, and ignition timing for timing the ignition of an ignition plug, not shown, according to the operating condition of the engine 2011.

The ECU 2030 executes a coolant temperature control routine, not shown. The ECU 2030 calculates a desired coolant temperature Td according to the operating condition of the engine 2011, and controls the flow control valve 2019 to adjust actual coolant temperature, i.e., the pump coolant temperature T1, to the desired coolant temperature Td. The ECU 2030 calculates a flow ratio R, i.e., the ratio between radiator flow rate Vr and bypass flow rate Vb on the basis of the pump coolant temperature T1, the bypass coolant temperature T2 and the radiator coolant temperature T3, calculates a desired flow rate ratio Rd between the radiator flow rate Vr and the bypass flow rate Vb on the basis of the desired coolant temperature Td and the bypass coolant temperature T2 and the radiator coolant temperature T3, and calculates a valve opening change by which the flow control valve 2019 is to be changed on the basis of the difference between the actual flow rate ratio R and the desired flow rate ratio Rd.

Figure 22:
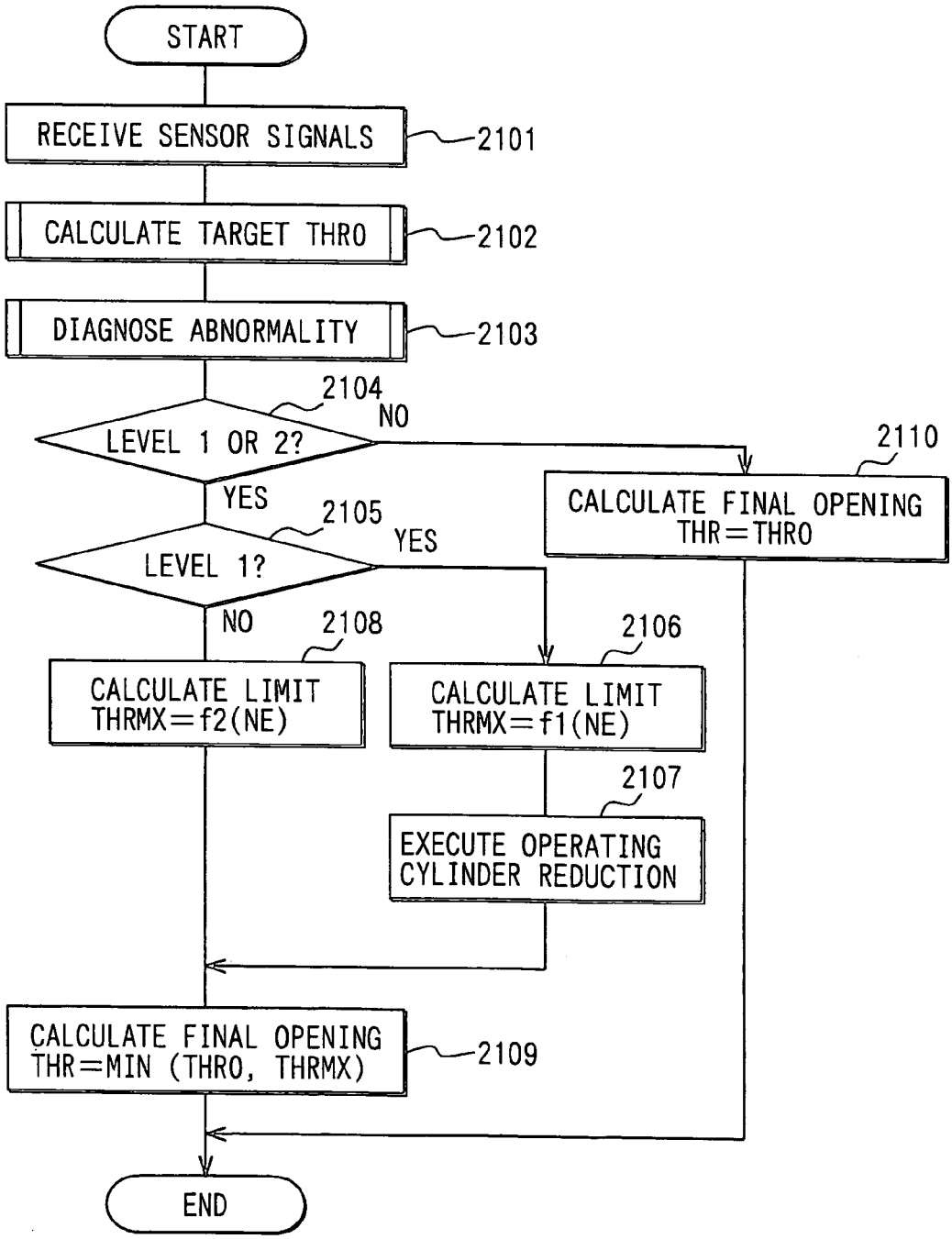
FIG. 22 is a flowchart of a fail-safe control base routine of the flow control valve carried out in the twelfth embodiment.
Figure 23:
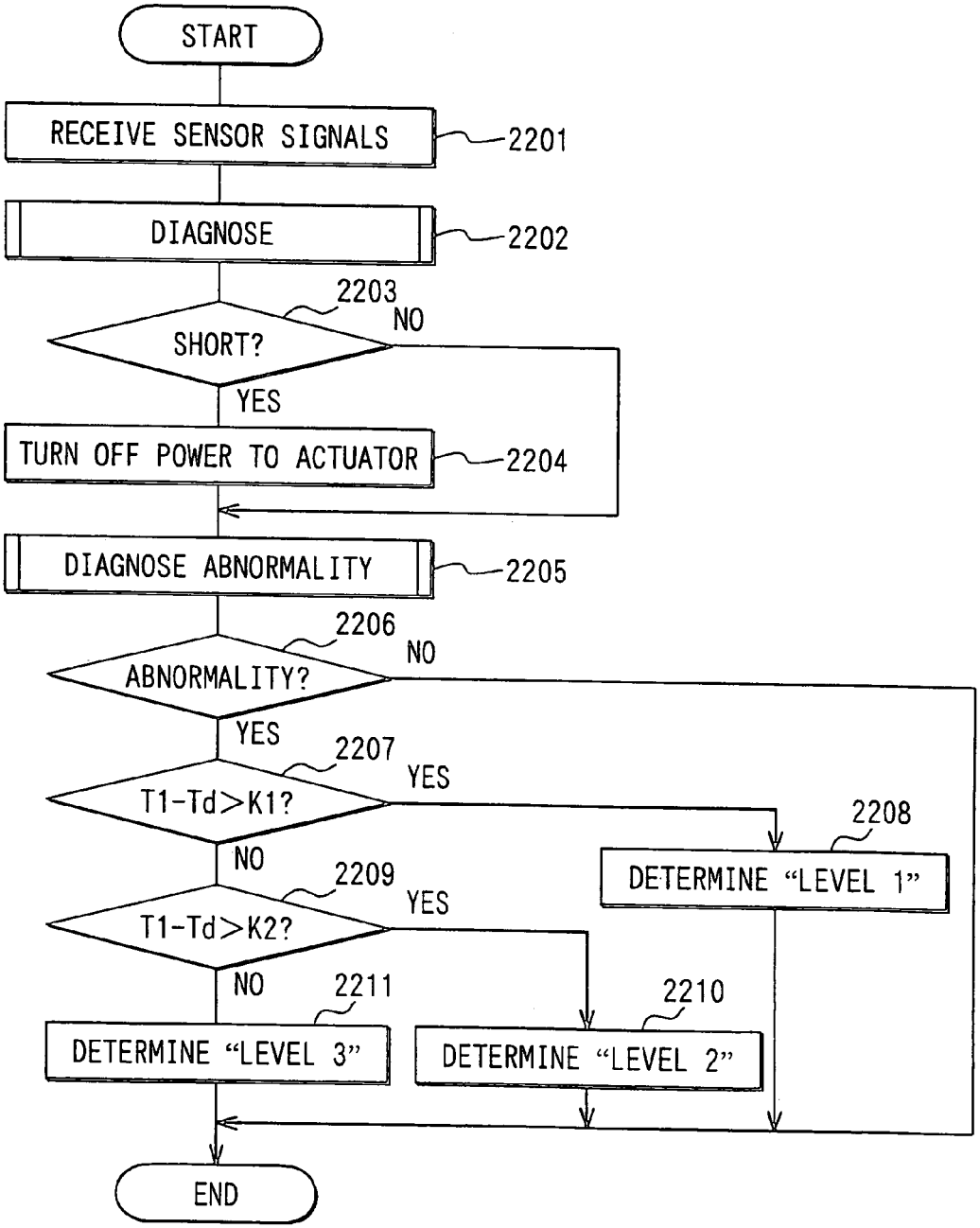
FIG. 23 is a flow chart of a valve diagnosing/abnormality level determining routine for locating abnormalitys and determining abnormality level carried out in the twelfth embodiment.
Figure 24:
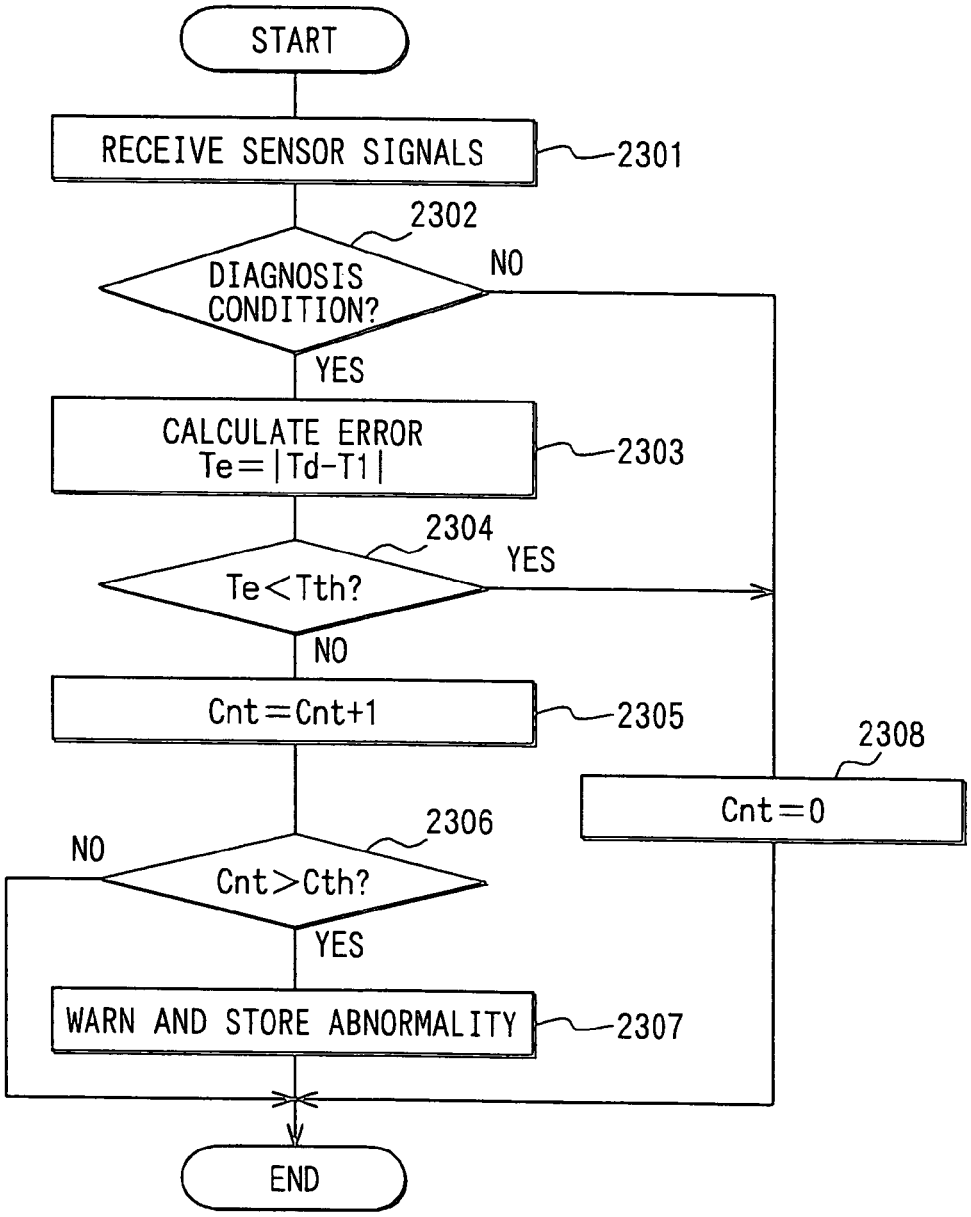
FIG. 24 is a flow chart of a flow control valve diagnosing routine for diagnosing a flow control valve for abnormality carried out in the twelfth embodiment.

The ECU 2030 executes routines shown in FIGS. 22 to 24 to achieve a fail-safe control operation for controlling the flow control valve 2019. In the fail-safe control operation, a determination is made as to whether or not the flow control valve 2019 is operating normally on the basis of the difference between the actual coolant temperature T1 measured by the coolant temperature sensor 2021 and the desired coolant temperature Td. If it is determined that the flow control valve 2019 is abnormal, the ECU 2030 specifies one of abnormality levels 1 to 3, i.e., degrees of abnormality.

When the abnormal condition of the flow control valve 2019 corresponds to the abnormality level 1, the difference between the actual coolant temperature T1 and the desired coolant temperature Td is greater than a first difference level K1. The possibility that the engine 2011 overheats is very high if the coolant temperature control is continued with the flow control valve 2019 at the abnormality level 1.

When the abnormal condition of the flow control valve 2019 corresponds to the abnormality level 2, the difference between the actual coolant temperature T1 and the desired coolant temperature Td is smaller than the first difference level K1 and greater than a second difference level K2 (K2<K1). The possibility that the engine 2011 overheats is comparatively low if the coolant temperature control is continued with the flow control valve 2019 at the abnormality level 2.

When the abnormal condition of the flow control valve 2019 corresponds to the abnormality level 3, the difference between the actual coolant temperature T1 and the desired coolant temperature Td is smaller than the second difference level K2. It is scarcely possible that the engine 2011 overheats if the coolant temperature control is continued with the flow control valve 2019 at the abnormality level 3.

When it is determined that the flow control valve 2019 is at the abnormality level 1, i.e., a level at which the possibility that the engine 2011 overheats is high, both a throttle opening limiting control operation and an operating cylinder reducing control operation are executed. Throttle opening limiting control operation sets a maximum throttle opening THRMX at f1 for the abnormality level 1 to reduce greatly the amount of air to be charged into each of the cylinders of the engine 2011 to reduce combustion heat so that heat generated by the engine 2011 is reduced. The operating cylinder reducing control operation stops injecting the fuel into some of the cylinders to inactivate the same cylinders (reduction of the number of operating cylinders) to reduce combustion heat accordingly so that heat generated by the engine 2011 is reduced.

When it is determined that the flow control valve 2019 is at the abnormality level 2, i.e., a level at which the possibility that the engine 2011 overheats is comparatively low, only the throttle opening limiting control operation is executed for heat generation rate reducing control. Throttle opening limiting control operation sets a maximum throttle opening THRMX at f2 (f2>f1) for the abnormality level 2 to reduce the amount of air to be charged into each of the cylinders of the engine 2011 to reduce combustion heat so that heat generated by the engine 2011 is reduced.

When it is determined that the flow control valve 2019 is at the abnormality level 3, i.e., a level at which it is scarcely possible that the engine 2011 overheats, any heat generation rate reducing operation is not executed, and regular normal control operations are executed.

The routines shown in FIGS. 22 to 24 executed by the ECU 2030 for the fail-safe control of the flow control valve 2019 will be described hereinafter.

(Fail-Safe Control of Flow Control Valve)

A fail-safe control base routine shown in FIG. 22 is started when an ignition switch, not shown, is turned on and then this routine is repeated at a predetermined period. The ECU 2030 receives output signals provided by the sensors at step 2101, and calculates a desired throttle opening THR0 on the basis of an accelerator position at step 2102.

A valve diagnosing/abnormality level determining routine shown in FIG. 23 is executed at step 2103 to diagnose the condition of the flow control valve 2019 and, if it is determined that the flow control valve 2019 is in an abnormal condition, to determine the abnormality level (a temperature difference by which the actual coolant temperature T1 is higher than the desired coolant temperature Td), i.e., one of the abnormality levels 1 to 3.

Then, a check is made at step 2104 to determine whether the flow control valve 2019 is at the abnormality level 1 or 2. If the flow control valve 2019 is at the abnormality level 1 or 2, a check is made at step 2105 to determine if the flow control valve 2019 is at the abnormality level 1.

If step 2105 determines that the flow control valve 2019 is at the abnormality level 1, i.e., a level at which the possibility that the engine 2011 overheats is high, a throttle opening limit f1(NE) for the present engine speed NE is retrieved from a map data of throttle opening limits f1 for the abnormality level 1. The throttle opening limit f1 (NE) is used as the maximum throttle opening THRMX, that is, THRMX=f1 (NE).

The map data of throttle opening limits f1 for the abnormality level 1 is designed such that the throttle opening limit f1(NE) is smaller than a throttle opening limit f2 for the abnormality level 2.

The operating cylinder reducing control operation is executed at step 2107 to interrupt injecting the fuel into some of the cylinders of the engine 2011 and to operate the rest of the cylinders.

The desired throttle opening THR0 calculated at step 2102 and the maximum throttle opening THRMX=f1 (NE) calculated at step 2106 are compared and the smaller one of those throttle openings is used as a final desired throttle opening THR.

Thus, the foregoing operations limits the throttle opening to the maximum throttle opening THRMX=f1 (NE) for the abnormality level 1 when the flow control valve 2019 is at the abnormality level 1 to limit the amount of air to be charged into each of the cylinders of the engine 2011 to reduce combustion heat so that heat generated by the engine 2011 is reduced accordingly, and stops injecting the fuel into some of the cylinders to inactivate the same cylinders to reduce combustion heat accordingly. Consequently, heat generated by the engine 2011 is reduced remarkably.

If it is determined at step 2104 that the flow control valve 2019 is at the abnormality level 2, i.e., a level at which the possibility that the engine 2011 overheats is comparatively low, a throttle opening limit f2(NE) for the present engine speed NE is retrieved from a map data of throttle opening limits f2 for the abnormality level 2 at step 2108. The throttle opening limit f2 (NE) is used as the maximum throttle opening THRMX, that is, THRMX=f2(NE).

The map of throttle opening limits f2 for the abnormality level 2 is designed such that the throttle opening limit f2 is greater than the throttle opening limit f1 for the abnormality level 1.

The desired throttle opening THR0 calculated at step 2102 and the maximum throttle opening THRMX=f2 (NE) calculated at step 2108 are compared and the smaller one of those throttle openings is used as a final desired throttle opening THR at step 2109.

Thus, the throttle opening is limited to the maximum throttle opening THRMX=f2 (NE) for the abnormality level 2 when the flow control valve 2019 is at the abnormality level 2 to limit the amount of air to be charged into each of the cylinders of the engine 2011 to reduce combustion heat so that heat generated by the engine 2011 is reduced accordingly. The foregoing procedure including steps 2104 to 2109 is a heat generation rate reducing control.

If it is determined that the flow control valve 2019 is at neither the abnormality level 1 nor the abnormality level 2, that is, if the flow control valve 2019 is at the abnormality level 3, i.e., a level at which it is scarcely possible that the engine 2011 overheats, or if the flow control valve 2019 is not abnormal, the heat generation rate reducing control operation is not executed. The desired throttle opening THR0 calculated on the basis of an accelerator position or the like at step 2102 as the final desired throttle opening THR at step 2110.

(Abnormality Location and Abnormality Level Determination)

The valve diagnosing/abnormality level determining routine shown in FIG. 23 for locating abnormalities and determining abnormality level is a subroutine to be started at step 2103 in FIG. 22. The fail-safe control base routine shown in FIG. 22 is started and, the ECU 2030 executes an information collecting procedure to receive output signals of the sensors at step 2201. A disconnection/short locating routine, not shown, at step 2202 to diagnose the actuator 2020 of the flow control valve 2019, and power lines for disconnection and short.

If there is any disconnection in the actuator 2020 of the flow control valve 2019 and/or the power lines, current cannot be supplied to the actuator 2020 and, consequently, the rotary valve element of the flow control valve 2019 is turned to an upper limit angular position to make the radiator flow rate Vr a maximum or an angular position near the upper limit angular position by the return spring or the like. Consequently, the heat removing rate of the radiator 2012 at which heat is removed from the coolant increases, the cooling ability of the coolant enhances, and thereby the engine 2011 is prevented from overheating.

If there is any short in the actuator 2020 of the flow control valve 2019 and/or the power line, current is supplied continuously to the actuator 2020, and the rotary valve element of the flow control valve 2019 is rotated in a direction to increase the radiator flow rate Vr, i.e., in a direction to increase the bypass flow rate Vb. Consequently, the heat removing rate of the radiator 2012 decreases, the cooling ability of the coolant decreases and, consequently, the engine 2011 may possibly overheat.

To prevent the engine 2011 from overheating due to electrical abnormalities in the actuator 2020 of the flow control valve 2019 and/or the power line, a check is made at step 2203 to determine if any short is located in the actuator 2020 of the flow control valve 2019 and/or the power line. If the result of check made at step 2203 is affirmative, the actuator 2020 of the flow control valve 2019 is disconnected from the power source at step 2204.

When the actuator 2020 of the flow control valve 2019 is thus disconnected from the power source, the rotary valve element of the flow control valve 2019 is rotated to the upper limit angular position to make the radiator flow rate Vr a maximum or an angular position near the upper limit angular position by the return spring or the like. Consequently, the heat removing rate of the radiator 2012 at which heat is removed from the coolant increases, the cooling ability of the coolant enhances, and thereby the engine 2011 can be prevented from overheating.

At step 2205, a flow control valve diagnosing routine shown in FIG. 24 for locating abnormalities in the flow control valve 2019 is executed to diagnose the flow control valve 2019 to determine if the flow control valve 2019 is abnormal, i.e., if the flow control valve 2019 is operating abnormally due to obstruction by foreign matters stuck in the flow control valve or the seizing of the rotary valve element, on the basis of the difference between the actual coolant temperature T1 measured by the coolant temperature sensor 2021 and the desired coolant temperature Td.

A check is made at step 2206 to determine if the flow control valve 2019 is abnormal. If the result of check at step 2206 is affirmative, the routine is ended.

If the flow control valve 2019 is determined to be abnormal, a check is made at step 2207 to determine if the difference between the actual coolant temperature T1 measured by the coolant temperature sensor 2021 and the desired coolant temperature Td is greater than a first difference level K1. If it is determined at step 2207 that the difference between the actual coolant temperature T1 and the desired coolant temperature Td is greater than the first difference level K1, it is determined at step 2208 that the flow control valve 2019 is at an abnormality level 1, i.e., a level at which the possibility that the engine 2011 overheats is high.

If it is determined at step 2207 that the difference between the actual coolant temperature T1 and the desired coolant temperature Td is not greater than the first difference level K1, a check is made at step 2209 to determine if the difference between the actual coolant temperature T1 and the desired coolant temperature Td is greater than -a second difference level K2 (K2<K1). If it is determined at step 2209 that the difference between the actual coolant temperature T1 and the desired coolant temperature Td is greater than the second difference level K2, it is determined at step 2210 that the flow control valve 2019 is at an abnormality level 2, i.e., a level at which the possibility that the engine 2011 overheats is comparatively low.

If it is determined at step 2209 that the difference between the actual coolant temperature T1 and the desired coolant temperature Td is not greater than the second difference level K2, it is determined at step 2211 that the flow control valve 2019 is at an abnormality level 3, i.e., a level at which it is scarcely possible that the engine 2011 overheats.

(Flow Control Valve Diagnosis)

A flow control valve diagnosing routine shown in FIG. 24 is a subroutine to be started at step 2205 of the valve diagnosing/abnormality level determining routine shown in FIG. 23.

The flow control valve diagnosing routine is started and the ECU 2030 executes an information collecting procedure to receive output signals of the sensors at step 2301. A check is made in 2302 to determine if a diagnosis condition for starting abnormality level determination, such as a condition in which the engine 2011 is in a steady traveling state operation, has been satisfied. If the starting condition has not been satisfied, a counter Cnt is reset to set the count to "0" at step 2308, and then the routine is ended.

If the starting condition has been satisfied, a temperature control error Te=|Td−T1| is calculated at step 2303.

A check is made at step 2304 to determine if the temperature control error Te is smaller than a threshold Tth. The threshold Tth is set according to parameters indicating the operating condition of the engine 2011, such as engine speed NE and load PM on the engine 2011.

If the response at step 2304 is affirmative, the count of the counter Cnt is set to "0" at step 2308, and then the routine is ended.

If the response at step 2304 is negative, a check is made at step 2305 and the count of the counter Cnt which counts the duration of a state where the temperature control error Te is not smaller than the threshold Tth is incremented by "1". Then, a check is made at step 2306 to determine if the count of the counter Cnt is greater than a predetermined value Cth. If the response at step 2306 is affirmative, the routine is ended. If the response at step 2306 is negative, i.e., if the duration of a state where the temperature control error Te is not smaller than the threshold Tth is longer than a time period corresponding to the predetermined value Cth, it is determined that the flow control valve 2019 is in an abnormal condition, an warning lamp, not shown, contained in the instrument panel disposed in front of the driver's seat is turned on or a warning is displayed on a warning display, not shown, to warn the driver and information about the abnormal condition, such as an abnormality code, is stored in a backup RAM, not shown, included in the ECU 2030 at step 2307, and then the routine is ended.

The internal combustion engine cooling system in the twelfth embodiment diagnoses the flow control valve 2019 to check whether or not the flow control valve 2019 is functioning properly, and executes the heat generation reducing operation to reduce heat generated by the engine 2011, i.e., the throttle opening limiting control operation and the operating cylinder reducing control operation when it is determined that the flow control valve 2019 is in an abnormal condition. Therefore, the heat generation rate of the engine 2011 can be reduced by the heat generation reducing operation to suppress the rise of the temperature of the engine 2011 to prevent the engine 2011 from overheating even if the coolant temperature increases due to a abnormality occurred in the flow control valve 2019, and the engine cooling ability of the internal combustion engine cooling system decreases. Thus, the vehicle is able to travel safely without causing the engine 2011 to overheat even if the flow control valve 2019 does not function normally.

When it is determined that the operation of the flow control valve 2019 is abnormal, the level of abnormality, such as the difference between the actual coolant temperature T1 and the desired coolant temperature Td, is determined. When the flow control valve 2019 is at the abnormality level 1, i.e., a level at which the possibility that the engine 2011 overheats is high, both the throttle opening limiting control that sets the maximum throttle opening THRMX at f1 for the abnormality level 1, and the operating cylinder reducing control operation are executed to reduce the heat generation rate of the engine 2011 greatly. When the flow control valve 2019 is at the abnormality level 2, i.e., a level at which the possibility that the engine 2011 overheats is comparatively low, only the throttle opening limiting control that sets the maximum throttle opening THRMX at f2 for the abnormality level 2 is executed to reduce the heat generation rate of the engine 2011.

Thus, the heat generation reducing operation determines the degree of reducing the heat generation rate of the engine 2011 selectively according to the level of abnormality of the flow control valve 2019. Consequently, the heat generation rate of the engine 2011 can be can be reduced only by a decrement necessary to prevent the engine 2011 from overheating. Thus, the excessive reduction of the heat generation rate of the engine 2011 can be prevented, and the reduction of the performance of the engine 2011 due to the heat generation rate reducing operation can be limited to the least unavoidable extent.

Even in a state where the operation of the flow control valve 2019 is determined to be abnormal, the coolant temperature of the coolant flowing into the engine 2011 does not increase or increases slightly when the radiator flow rate Vr is higher or slightly lower than the normal radiator flow rate. Therefore, the cooling capacity of the coolant decreases scarcely in such a state. Thus, it may hardly be possible that the engine 2011 overheats in such a state.

Even in a state where the operation of the flow control valve 2019 is determined to be abnormal, the heat generation rate control operation is not executed and the normal control operation is executed when it is determined that the flow control valve 2019 is at the abnormality level 3, i.e., a level at which it is scarcely possible that the engine 2011 overheats. Thus, the heat generation rate reducing control operation need not be executed in a state where it is scarcely possible that the engine 2011 overheats, and hence the deterioration of the performance of the engine 2011 due to the heat generation rate reducing control operation can be avoided.

Although the heat generation rate reducing control operation in the twelfth embodiment includes the throttle opening limiting control operation and the operating cylinder reducing control operation, the heat generation rate reducing control operation may include a fuel-cutting operation. The fuel-cutting operation reduces combustion heat and thereby the heat generation rate of the engine 2011 can be reduced accordingly.

When the engine 2011 is a direct injection type capable of a stratified-charge learn-burn operation, the heat generation rate reducing control operation may include a stratified-charge lean-burn control operation. A stratified-charge lean-burn operation can use a lean air-fuel mixture, and thereby combustion heat generated by each cylinder can be reduced to reduce the heat generation rate of the engine 2011.

When the engine 2011 is provided with a valve control system including a variable valve timing mechanism capable of varying valve control parameters including valve timing and lifts of the intake and the exhaust valves, the heat generation rate reducing control operation may include a valve control quantity changing operation. The valve control quantity changing operation, similarly to the throttle opening limiting operation, is able to reduce the heat generation rate of the engine 2011 by changing valve control quantity including valve timing and valve lifts so that the amount of air that can be charged into each cylinder may be reduced.

Only one of the operations for the heat generation rate reducing control operation including the throttle opening limiting operation, the operating cylinder reducing operation, the fuel-cutting operation, the stratified-charge lean-burn operation and the valve control quantity changing operation may be executed or some of those operations may be executed in combination. The combination of those operations for the heat generation rate reducing control operation may be determined and the control quantity may be changed according to the abnormality level.

Although the twelfth embodiment uses the three abnormality levels, two abnormality levels or four or more abnormality levels may be used for representing the condition of the flow control valve 2019.

To simplify the fail-safe control operation, the step of determining the abnormality level may be omitted, and the same heat generation rate reducing control operation may be executed to control the same control quantity when it is determined that operation of the flow control valve 2019 is abnormal.

Although the flow control valve 2019 is placed at the junction of the bypass passage 2018 and the outlet passage 2014 in the twelfth embodiment to control both the bypass flow rate Vb and the radiator flow rate Vr by the single flow control valve 2019, flow control valves may be placed in the bypass passage 2018 and the outlet passage 2014, respectively, to control the bypass flow rate Vb and the radiator flow rate Vr individually by the two flow control valve. When the two flow control valves are used, the two flow control valves are examined to determine their operating condition, and the heat generation rate reducing control operation may be executed even when it is determined that the operation of either of the two flow control valves is abnormal.

The coolant temperature sensor may be placed at any suitable position, such as a position near the outlet of the water jacket of the engine 2011.

The twelfth embodiment may be combined with the first to eleventh embodiments.

What is claimed is:

1. An internal combustion engine cooling system including a flow control valve capable of controlling flow rate of cooling water flowing through a bypass passage bypassing a radiator, and a coolant temperature control means for controlling coolant temperature by controlling the flow control valve, the system comprising:

a valve diagnosing means for diagnosing the flow control valve for abnormalities;

a heat generation rate reducing control means that executes a heat generation rate reducing control operation to reduce heat generation rate of the internal combustion engine when the valve diagnosing means determines that the flow control valve is in an abnormal condition; and an abnormality level determining means for determining abnormality level of the flow control valve among a plurality of abnormality levels when the valve diagnosing means determines that the flow control valve is in an abnormal condition, wherein the heat generation rate reducing control means sets control parameters and/or control quantity for the heat generation rate reducing control operation according to the abnormality level determined by the valve diagnosing means.

2. The internal combustion engine cooling system according to claim 1, wherein the heat generation rate reducing control means does not execute the heat generation rate reducing control operation when the abnormality level of the flow control valve determined by the abnormality level determining means is below a predetermined abnormality level, even if the valve diagnosing means determines that the flow control valve is in an abnormal condition.

3. An internal combustion engine cooling system including a flow control valve capable of controlling flow rate of cooling water flowing through a bypass passage bypassing a radiator, and a coolant temperature control means for controlling coolant temperature by controlling the flow control valve, the system comprising:

a valve diagnosing means for diagnosing the flow control valve for abnormalities; and a heat generation rate reducing control means that executes a heat generation rate reducing control operation to reduce heat generation rate of the internal combustion engine when the valve diagnosing means determines that the flow control valve is in an abnormal condition, wherein the heat generation rate reducing control means achieves the heat generation rate reducing control operation by using at least one of fuel cutting, stratified-charge lean combustion, operating cylinder reduction and changing control quantity of a variable intake valve system and/or a variable exhaust valve system.

4. An internal combustion engine cooling system including a flow control valve capable of controlling flow rate of cooling water flowing through a bypass passage bypassing a radiator, and a coolant temperature control means for controlling coolant temperature by controlling the flow control valve, the system comprising:

a valve diagnosing means for diagnosing the flow control valve for abnormalities;

a heat generation rate reducing control means that executes a heat generation rate reducing control operation to reduce heat generation rate of the internal combustion engine when the valve diagnosing means determines that the flow control valve is in an abnormal condition; and a coolant temperature measuring means;

wherein the coolant temperature control means controls the flow control valve based on the measured coolant temperature so that a coolant temperature measured by the coolant temperature measuring means may be adjusted to a desired coolant temperature, and the valve diagnosing means compares a measured coolant temperature measured by the coolant temperature measuring means and the desired coolant temperature while the coolant temperature control means is in a coolant temperature control operation, and determines whether the flow control valve is in an abnormal condition on the basis of the result of comparison of the measured coolant temperature and the desired coolant temperature.

5. An internal combustion engine cooling system including a flow control valve capable of controlling flow rate of cooling water flowing through a bypass passage bypassing a radiator, and a coolant temperature control means for controlling coolant temperature by controlling the flow control valve, the system comprising:

a valve diagnosing means for diagnosing the flow control valve for abnormalities; and a heat generation rate reducing control means that executes a heat generation rate reducing control operation to reduce heat generation rate of the internal combustion engine when the valve diagnosing means determines that the flow control valve is in an abnormal condition, wherein the heat generation rate reducing means includes:

an abnormality level determining means for determining abnormality level of the flow control valve when it is determined that the flow control valve is in an abnormal condition;

a throttle control means for controlling flow rate of intake air flowing into each of cylinders of the internal combustion engine by adjusting throttle opening of a throttle valve placed in an intake passage of the internal combustion engine; and an operating cylinder reducing control means for interrupting combustion in some of cylinders of the internal combustion engine, wherein a throttle opening control operation and a operating cylinder reducing operation are carried out so that heat generation rate of the internal combustion engine is reduced according to the abnormality level determined by the abnormality level determining means.

6. The internal combustion engine cooling system according to claim 5, wherein throttle control means of the heat generation rate reducing means limits maximum throttle opening of the throttle valve to a predetermined first throttle opening and executes the operating cylinder reducing control operation when the abnormality level determining means determines that the flow control valve is at a high abnormality level, and the throttle control means limits maximum throttle opening of the throttle valve to a predetermined second throttle opening when the abnormality level determining means determines that the flow control valve is at a low abnormality level.

7. Method of cooling an internal combustion engine comprising:

controlling a flow control valve capable of controlling flow rate of cooling water flowing through a bypass passage bypassing a radiator;

diagnosing the flow control valve for abnormalities;

selectively executing a heat generation rate reducing control operation to reduce heat generation rate of the internal combustion engine when said diagnosing determines that the flow control valve is in an abnormal condition;

determining an abnormality level of the flow control valve among a plurality of abnormality levels when said diagnosing determines that the flow control valve is in an abnormal condition, and wherein said executing includes selectively setting control parameters and/or control quantity for the heat generation rate reducing control operation according to the abnormality level determined by the valve diagnosing means.

8. The method according to claim 7, wherein the heat generation rate reducing control operation is not executed when the determined abnormality level is below a predetermined abnormality level, even if the flow control valve is determined to be in an abnormal condition.

9. Method of cooling an internal combustion engine comprising:

controlling a flow control valve capable of controlling flow rate of cooling water flowing through a bypass passage bypassing a radiator;

diagnosing the flow control valve for abnormalities; and selectively executing a heat generation rate reducing control operation to reduce heat generation rate of the internal combustion engine when said diagnosing determines that the flow control valve is in an abnormal condition;

said heat generation rate reducing control operation is executed by using at least one of fuel cutting, stratified-charge lean combustion, operating cylinder reduction and changing control quantity of a variable intake valve system and/or a variable exhaust valve system.

10. Method of cooling an internal combustion engine comprising:

controlling a flow control valve capable of controlling flow rate of cooling water flowing through a bypass passage bypassing a radiator;

diagnosing the flow control valve for abnormalities;

selectively executing a heat generation rate reducing control operation to reduce heat generation rate of the internal combustion engine when said diagnosing determines that the flow control valve is in an abnormal condition;

measuring a coolant temperature;

wherein the flow control valve is controlled based on the measured cooling temperature so that a measured coolant temperature may be adjusted to a desired coolant temperature, and said diagnosing includes comparing a measured coolant temperature and the desired coolant temperature while the flow control valve is being controlled, and determining whether the flow control valve is in an abnormal condition on the basis of the result of comparison of the measured coolant temperature and the desired coolant temperature.

11. Method of cooling an internal combustion engine comprising:

controlling a flow control valve capable of controlling flow rate of cooling water flowing through a bypass passage bypassing a radiator;

diagnosing the flow control valve for abnormalities; and selectively executing a heat generation rate reducing control operation to reduce heat generation rate of the internal combustion engine when said diagnosing determines that the flow control valve is in an abnormal condition;

wherein the heat generation rate reducing control operation includes:

determining an abnormality level of the flow control valve when it is determined that the flow control valve is in an abnormal condition;

controlling a flow rate of intake air flowing into each of cylinders of the internal combustion engine by adjusting a throttle opening of a throttle valve placed in an intake passage of the internal combustion engine; and interrupting combustion in some of cylinders of the internal combustion engine, wherein said adjusting a throttle opening and said interrupting combustion are carried out so that heat generation rate of the internal combustion engine is reduced according to the determined abnormality level.

12. The method according to claim 11, wherein said controlling a flow rate limits maximum throttle opening of the throttle valve to a predetermined first throttle opening and executes the combustion interruption when the abnormality level is determined to be a high abnormality level, and said controlling a flow rate limits maximum throttle opening of the throttle valve to a predetermined second throttle opening when the abnormality level is determined to be a low abnormality level.

* * * * *